US012742313B2

(12) United States Patent
Izumikawa

(10) Patent No.: US 12,742,313 B2
(45) Date of Patent: Sep. 22, 2026

(54) SHOVEL AND SHOVEL CONTROL DEVICE

(71) Applicant: SUMITOMO CONSTRUCTION MACHINERY CO., LTD., Tokyo (JP)

(72) Inventor: Takeya Izumikawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 109 days.

(21) Appl. No.: 18/471,565

(22) Filed: Sep. 21, 2023

(65) Prior Publication Data

US 2024/0011253 A1 Jan. 11, 2024

Related U.S. Application Data

(63) Continuation of application No. PCT/JP2022/012660, filed on Mar. 18, 2022.

(30) Foreign Application Priority Data

Mar. 22, 2021 (JP) ..... 2021-047751

(51) Int. Cl.
*E02F 3/32* (2006.01)
*E02F 3/43* (2006.01)
*E02F 9/26* (2006.01)

(52) U.S. Cl.
CPC ..... *E02F 9/265* (2013.01); *E02F 3/32* (2013.01); *E02F 3/435* (2013.01)

(58) Field of Classification Search
CPC . E02F 9/24; E02F 9/2033; E02F 9/123; E02F 9/265; E02F 9/262; E02F 9/2285; E02F 9/2292; E02F 9/2296; E02F 9/2282; E02F 3/437; E02F 3/435; E02F 3/32
See application file for complete search history.

(56) References Cited

U.S. PATENT DOCUMENTS 10,344,450 B2 7/2019 Sharp et al.
2015/0275483 A1* 10/2015 Tsukamoto ..... F16P 3/141 701/50
2015/0308081 A1 10/2015 Takakura et al.
2017/0342680 A1* 11/2017 Iwamura ..... E02F 9/262
(Continued)

FOREIGN PATENT DOCUMENTS

EP 3770343 1/2021
JP H02-15659 U 1/1990
(Continued)

OTHER PUBLICATIONS

Machine translation of the description of WO-2020179346-A1, Narikawa, Sep. 10, 2020, pp. 1-15 (Year: 2025).*
(Continued)

*Primary Examiner* — Navid Z. Mehdizadeh
*Assistant Examiner* — Jared C Bean
(74) *Attorney, Agent, or Firm* — IPUSA, PLLC

(57) ABSTRACT

A shovel includes a lower traveling body; an upper turning body turnably mounted on the lower traveling body; an attachment mounted on the upper turning body; and a control device including a memory storing a program and a processor configured to execute a process including automatically decelerating or stopping turning of the upper turning body when interference between the attachment and a control reference surface is predicted while the upper turning body is turning.

18 Claims, 10 Drawing Sheets

(56) References Cited

U.S. PATENT DOCUMENTS

| | | | | |
|---|---|---|---|---|
| 2018/0347147 | A1 | 12/2018 | Doi et al. | |
| 2021/0010236 | A1 | 1/2021 | Nishi | |
| 2021/0180291 | A1* | 6/2021 | Saiki | E02F 9/26 |
| 2021/0262196 | A1 | 8/2021 | Ito | |

FOREIGN PATENT DOCUMENTS

| | | | | |
|---|---|---|---|---|
| JP | 2004169428 | A * | 6/2004 | |
| JP | 2006-307436 | | 11/2006 | |
| JP | 2013-217137 | | 10/2013 | |
| JP | 2018-199989 | | 12/2018 | |
| JP | 2019-108722 | | 7/2019 | |
| JP | 2019-190163 | | 10/2019 | |
| JP | 2020-169515 | | 10/2020 | |
| WO | 2014/192474 | | 12/2014 | |
| WO | 2019/189030 | | 10/2019 | |
| WO | WO-2019189935 | A1 * | 10/2019 | E02F 9/2296 |
| WO | 2020/101005 | | 5/2020 | |
| WO | WO-2020179346 | A1 * | 9/2020 | E02F 9/26 |

OTHER PUBLICATIONS

Machine translation of the description of JP 2004169428 A, Kanda, Jun. 17, 2004, pp. 1-15 (Year: 2025).*

Machine translation of the description of WO 2019189935 A1, Nishi, Oct. 3, 2019, pp. 1-23 (Year: 2025).*

International Search Report for PCT/JP2022/012660 mailed on May 24, 2022.

* cited by examiner

SHOVEL AND SHOVEL CONTROL DEVICE

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2022/012660, filed on Mar. 18, 2022, and designating the U.S., which claims priority to Japanese Patent Application No. 2021-047751 filed on Mar. 22, 2021. The entire contents of the foregoing applications are incorporated herein by reference.

BACKGROUND

Technical Field

The present disclosure relates to a shovel as an excavator, and a shovel control device.

Description of Related Art

Related-art hydraulic shovels are known to be automatically controlled to perform land leveling work automatically. Such hydraulic shovels are configured to perform a control to force a boom to rise when a cutting edge of a bucket is likely to fall below a design surface in order to avoid excavating a surface deeper than the design surface.

SUMMARY

According to an aspect of the present disclosure, a shovel includes a lower traveling body; an upper turning body turnably mounted on the lower traveling body; an attachment mounted on the upper turning body; and a control device including a memory storing a program and a processor configured to execute a process including automatically decelerating or stopping turning of the upper turning body when interference between the attachment and a control reference surface is predicted while the upper turning body is turning.

DETAILED DESCRIPTION

According to the related-art hydraulic shovels, when the boom is forced to rise, the boom may come into contact with an object such as an electric wire above the hydraulic shovel.

Accordingly, it is desirable to provide a shovel with more appropriate automatic control.

According to an embodiment of the present disclosure, a shovel with more appropriate automatic control may be provided.

Figure 1:
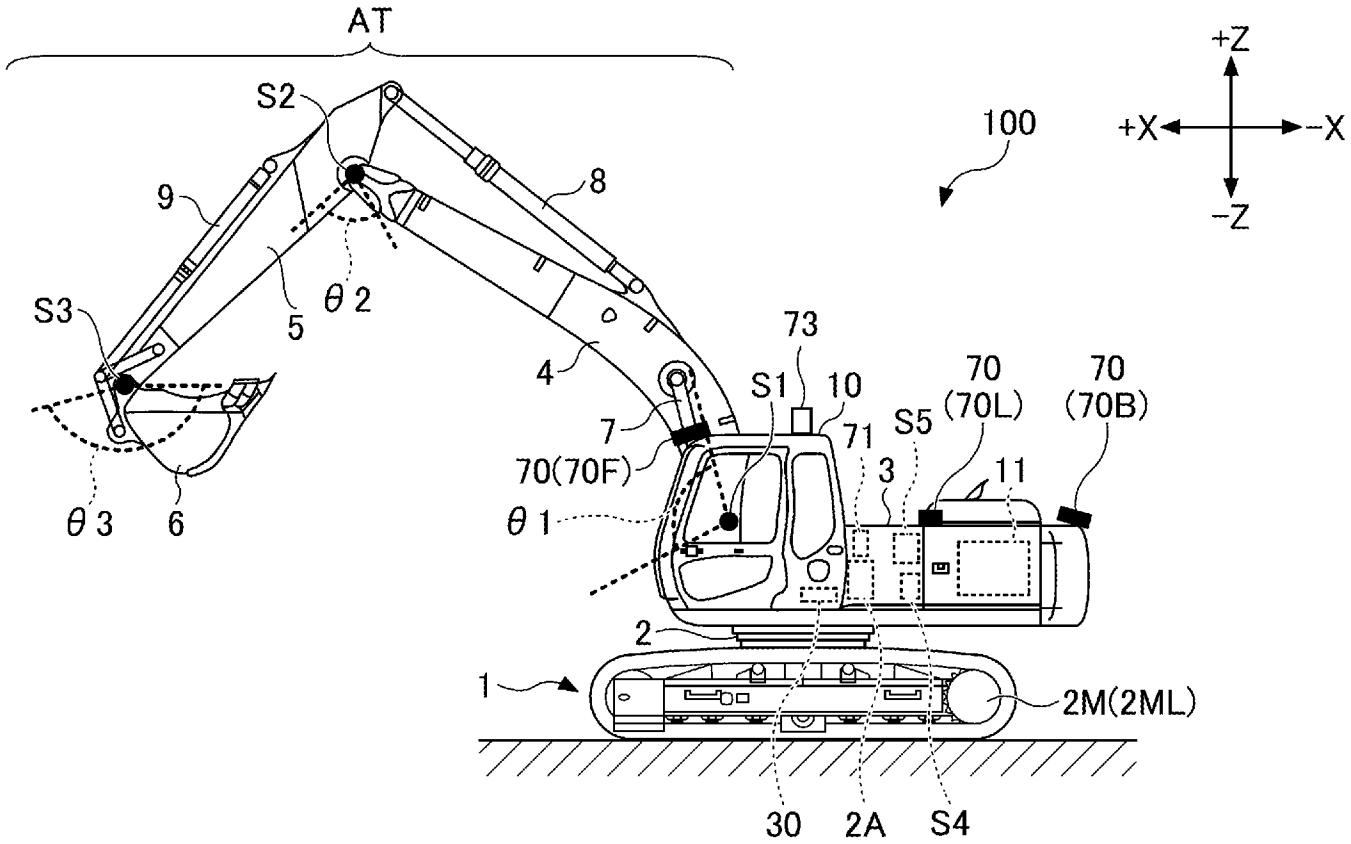
FIG. 1 is a side view illustrating a shovel according to an embodiment of the present invention.
Figure 2:
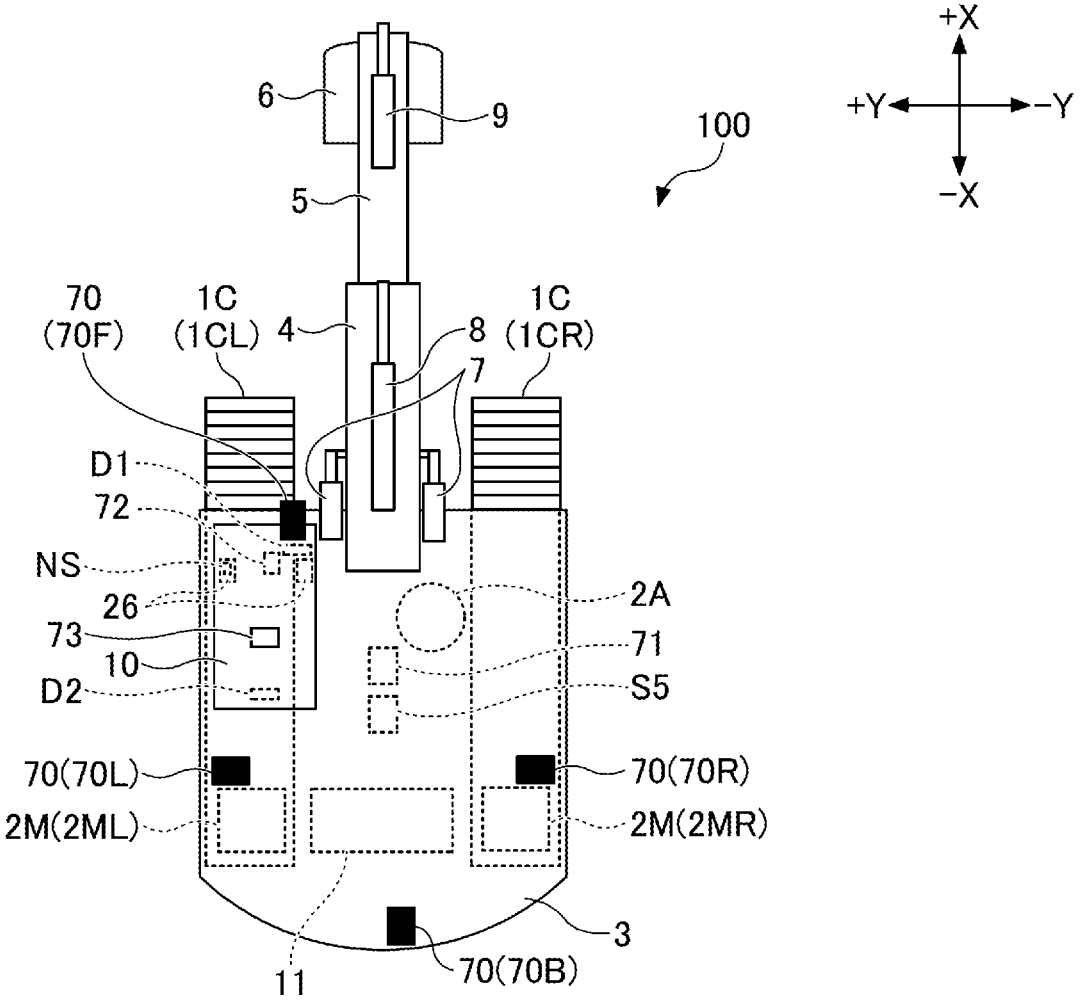
FIG. 2 is a top view illustrating the shovel of FIG. 1.

First, a shovel 100 as an excavator according to an embodiment of the present disclosure will be described with reference to FIGS. 1 and 2. FIG. 1 is a side view illustrating the shovel 100, and FIG. 2 is a top view illustrating the shovel 100.

In the present embodiment, a lower traveling body 1 of the shovel 100 includes a crawler 1C. The crawler 1C is driven by a traveling hydraulic motor 2M as a traveling actuator mounted on the lower traveling body 1. Specifically, the crawler 1C includes a left crawler 1CL and a right crawler 1CR. The left crawler 1CL is driven by a left traveling hydraulic motor 2ML, and the right crawler 1CR is driven by a right traveling hydraulic motor 2MR.

An upper turning body 3 is mounted on the lower traveling body 1 so as to be able to turn through a turning mechanism 2. The turning mechanism 2 is driven by a turning hydraulic motor 2A as a turning actuator mounted on the upper turning body 3. However, the turning actuator may be a turning electric generator as an electric actuator.

A boom 4 is attached to the upper turning body 3. An arm 5 is attached to the tip of the boom 4, and a bucket 6 as an end attachment is attached to the tip of the arm 5. The boom 4, the arm 5, and the bucket 6 constitute an excavation attachment AT which is an example of an attachment. The boom 4 is driven by a boom cylinder 7, the arm 5 is driven by an arm cylinder 8, and the bucket 6 is driven by a bucket cylinder 9. The boom cylinder 7, the arm cylinder 8, and the bucket cylinder 9 constitute an attachment actuator. The bucket 6 may be, for example, a slope bucket. The bucket 6 may also include a bucket tilt mechanism.

The boom 4 is supported in a vertically rotatable manner with respect to the upper turning body 3. A boom angle sensor S1 is attached to the boom 4. The boom angle sensor S1 can detect a boom angle θ1 which is a rotating angle of the boom 4. The boom angle θ1 is, for example, a rising angle from a state in which the boom 4 is lowered most. Therefore, the boom angle θ1 is maximum when the boom 4 is raised most.

The arm 5 is rotatably supported with respect to the boom 4. An arm angle sensor S2 is attached to the arm 5. The arm angle sensor S2 can detect an arm angle θ2 which is a rotating angle of the arm 5. The arm angle θ2 is, for example, an opening angle from a state where the arm 5 is closed most. Therefore, the arm angle θ2 is maximum when the arm 5 is opened most.

The bucket 6 is rotatably supported with respect to the arm 5. A bucket angle sensor S3 is attached to the bucket 6. The bucket angle sensor S3 can detect a bucket angle θ3 which is the rotating angle of the bucket 6. The bucket angle θ3 is the opening angle of the bucket 6 from the most closed state. Therefore, the bucket angle θ3 is maximum when the bucket 6 is opened most.

In the embodiment of FIG. 1, the boom angle sensor S1, the arm angle sensor S2, and the bucket angle sensor S3 each include a combination of an acceleration sensor and a gyro sensor. However, the boom angle sensor S1, the arm angle sensor S2, and the bucket angle sensor S3 may each include an acceleration sensor alone. The boom angle sensor S1 may be a stroke sensor attached to the boom cylinder 7, a rotary encoder, a potentiometer, or an inertial measurement device. The same applies to the arm angle sensor S2 and the bucket angle sensor S3.

The upper turning body 3 is provided with a cabin 10 as a driver's compartment, and is mounted with a power source such as an engine 11. A space recognition device 70, an orientation detection device 71, a positioning device 73, a body inclination sensor S4, and a turning angular velocity sensor S5 are attached to the upper turning body 3. An operation device 26, a controller 30, an information input device 72, a display device D1, and a sound output device D2 are provided inside the cabin 10. In the present specification, for convenience, a side to which the excavation attachment AT is attached is designated as a front side, and a side to which a counterweight is attached is designated as a rear side of the upper turning body 3.

The space recognition device 70 is configured to recognize an object existing in three-dimensional space around the shovel 100. The space recognition device 70 may be configured to calculate a distance from the space recognition device 70 or the shovel 100 to the recognized object. The space recognition device 70 may include, for example, an ultrasonic sensor, a millimeter wave radar, an imaging device, a LIDAR, a range image sensor, an infrared sensor, or any combination of these sensors. The imaging device is, for example, a monocular camera or a stereo camera. In the present embodiment, the space recognition device 70 includes a front sensor 70F attached to a front end of the upper surface of the cabin 10, a rear sensor 70B attached to a rear end of the upper surface of the upper turning body 3, a left sensor 70L attached to a left end of the upper surface of the upper turning body 3, and a right sensor 70R attached to a right end of the upper surface of the upper turning body 3. An upper sensor that recognizes an object in the space above the upper turning body 3 may be attached to the shovel 100.

An orientation detection device 71 is configured to detect information about a relative relationship between an orientation of the upper turning body 3 and an orientation of the lower traveling body 1. The orientation detection device 71 may include, for example, a combination of a geomagnetic sensor attached to the lower traveling body 1 and a geomagnetic sensor attached to the upper turning body 3. Alternatively, the orientation detection device 71 may include a combination of a GNSS receiver attached to the lower traveling body 1 and a GNSS receiver attached to the upper turning body 3. The orientation detection device 71 may be a rotary encoder, a rotor position sensor, or any combination thereof. In a configuration in which the upper turning body 3 is driven to turn by a turning motor generator, the orientation detection device 71 may be configured with a resolver. The orientation detection device 71 may be attached, for example, to a center joint provided in association with a turning mechanism 2 that provides relative rotation between the lower traveling body 1 and the upper turning body 3.

The orientation detection device 71 may include a camera mounted on the upper turning body 3. In this case, the orientation detection device 71 applies known image processing to an image (input image) captured by the camera mounted on the upper turning body 3 to detect an image of the lower traveling body 1 included in the input image. The orientation detection device 71 then detects the image of the lower traveling body 1 using a known image recognition technique to specify a longitudinal direction of the lower traveling body 1. The angle formed between the direction of the front-back axis of the upper turning body 3 and the longitudinal direction of the lower traveling body 1 is then derived. The direction of the front-back axis of the upper turning body 3 is derived from the mounting position of the camera. In particular, since the crawler 1C projects from the upper turning body 3, the orientation detection device 71 can specify the longitudinal direction of the lower traveling body 1 by detecting the image of the crawler 1C. In this case, the orientation detection device 71 may be integrated with the controller 30. The camera may also be a space recognition device 70.

The information input device 72 is configured such that an operator of the shovel can input information to the controller 30. In the present embodiment, the information input device 72 is a switch panel installed close to the display portion of the display device D1. However, the information input device 72 may be a touch panel arranged on the display portion of the display device D1 or a sound input device such as a microphone arranged in the cabin 10. The information input device 72 may be a communication device that acquires information from the outside.

The positioning device 73 is configured to measure a position of the upper turning body 3. In the present embodiment, the positioning device 73 is a GNSS receiver that detects the position of the upper turning body 3 and outputs the detected value to the controller 30. The positioning device 73 may be a GNSS compass. In this case, the positioning device 73 can detect the position and the orientation of the upper turning body 3, and thus also functions as an orientation detection device 71.

The body inclination sensor S4 detects an inclination of the upper turning body 3 with respect to a predetermined plane. In the present embodiment, the body inclination sensor S4 is an acceleration sensor for detecting the inclination angle of the upper turning body 3 with respect to the horizontal plane around the front-back axis and an inclination angle around the left-right axis. The front-back axis and the left-right axis of the upper turning body 3 are, for example, orthogonal to each other that pass through the center point of the shovel, which is a point on a turning axis of the shovel 100.

The turning angular velocity sensor S5 detects a turning angular velocity of the upper turning body 3. In the present embodiment, it is a gyro sensor. It may be a resolver, a rotary encoder, or any combination thereof. The turning angular velocity sensor S5 may detect the turning velocity. The turning velocity may be calculated from the turning angular velocity.

Hereinafter, at least one of the boom angle sensor S1, the arm angle sensor S2, the bucket angle sensor S3, the body inclination sensor S4, and the turning angular velocity sensor S5 is also referred to as an attitude detection device. The attitude of the excavation attachment AT is detected based on the respective outputs of the boom angle sensor S1, the arm angle sensor S2, and the bucket angle sensor S3, for example.

The display device D1 is a device that displays information. In the present embodiment, the display device D1 is a liquid crystal display installed in the cabin 10. However, the display device D1 may be a display of a mobile terminal such as a smartphone.

The sound output device D2 is a device that outputs sound. The sound output device D2 includes at least one of a device that outputs sound to an operator in the cabin 10 and a device that outputs sound to an operator outside the cabin 10. The sound output device D2 may be a speaker of a mobile terminal.

The operation device 26 is a device used by an operator for operating an actuator. The operation device 26 includes, for example, an operation lever and an operation pedal. The actuator includes at least one of a hydraulic actuator and an electric actuator.

The controller 30 is a control device for controlling the shovel 100. In the present embodiment, the controller 30 is configured to include a computer having a CPU, a volatile storage device, a nonvolatile storage device, and the like. The controller 30 reads a program corresponding to each function from the nonvolatile storage device, loads the program into the volatile storage device, and causes the CPU to execute the corresponding processing. Each function includes, for example, a machine guidance function that guides a manual operation of the shovel 100 by the operator, and a machine control function that assists the manual operation of the shovel 100 by the operator or causes the shovel 100 to operate automatically or autonomously. The controller 30 may include a contact avoidance function that causes the shovel 100 to automatically or autonomously operate or stop in order to avoid contact between the shovel 100 and objects present in a monitoring range around the shovel 100. Monitoring of objects around the shovel 100 is applied not only within the monitoring range but also outside the monitoring range.

Figure 3:
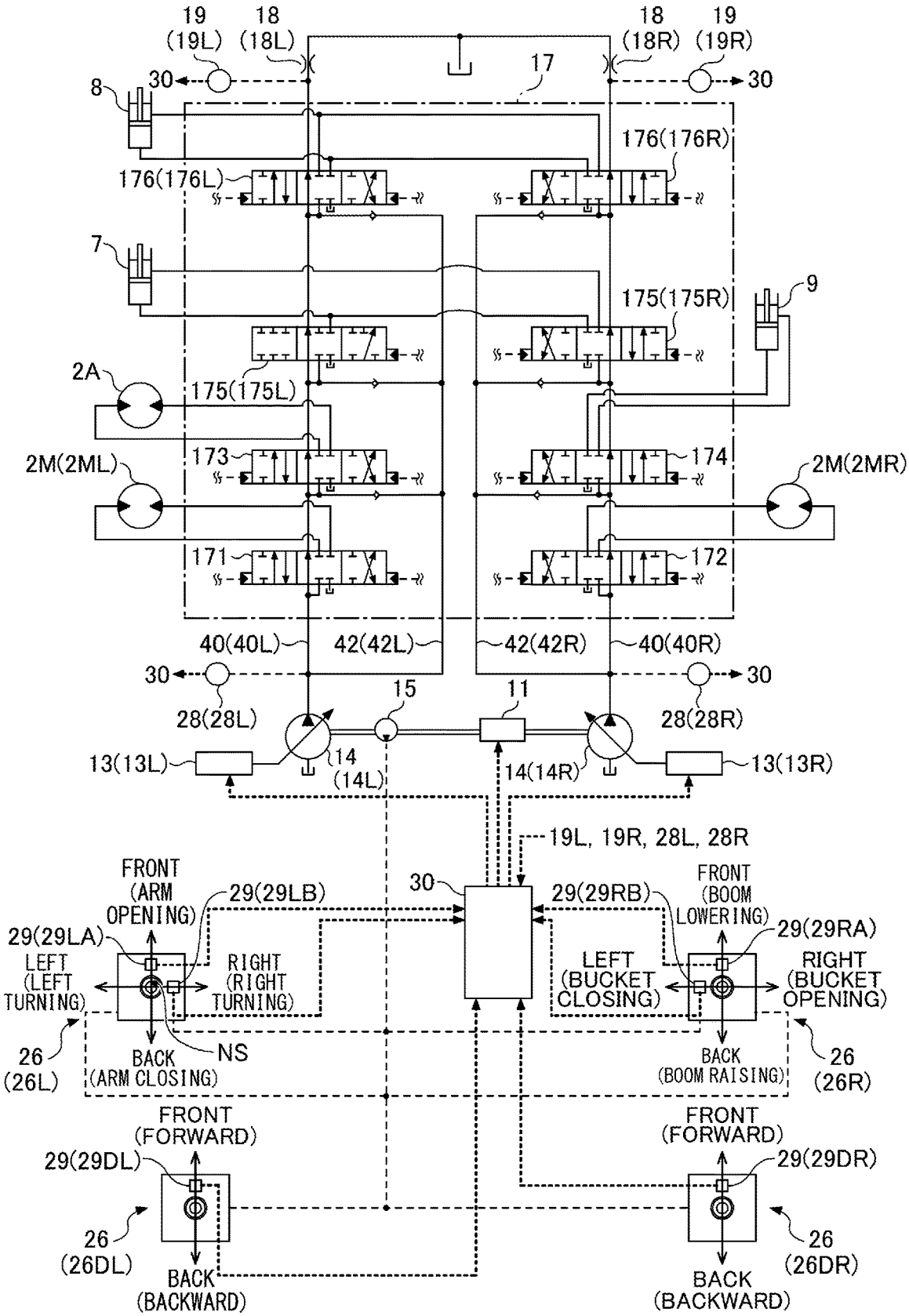
FIG. 3 is a diagram illustrating an example of a configuration of a hydraulic system mounted on the shovel of FIG. 1.

Next, an example of a configuration of a hydraulic system mounted on the shovel 100 will be described with reference to FIG. 3. FIG. 3 is a diagram illustrating the example of the configuration of the hydraulic system mounted on the shovel 100. In FIG. 3, a mechanical power transmission system, a hydraulic fluid line, a pilot line, and an electrical control system are illustrated with double lines, solid lines, broken lines, and dotted lines, respectively.

The hydraulic system of the shovel 100 mainly includes an engine 11, a regulator 13, a main pump 14, a pilot pump 15, a control valve unit 17, an operation device 26, a discharge pressure sensor 28, an operation sensor 29, a controller 30, and the like.

In FIG. 3, the hydraulic system is configured to circulate hydraulic fluid from the main pump 14 driven by the engine 11 to a hydraulic fluid tank via a center bypass conduit 40 or a parallel conduit 42.

The engine 11 is a driving source of the shovel 100. In the present embodiment, the engine 11 is, for example, a diesel engine that operates to maintain a predetermined velocity. The output shaft of the engine 11 is coupled to the respective input shafts of the main pump 14 and the pilot pump 15.

The main pump 14 is configured to supply hydraulic fluid to the control valve unit 17 via the hydraulic fluid line. In the present embodiment, the main pump 14 is a swashplate type variable displacement hydraulic pump.

The regulator 13 is configured to control a discharge amount of the main pump 14. In the present embodiment, the regulator 13 controls the discharge amount of the main pump 14 by adjusting a swash plate inclination angle of the main pump 14 in response to a control instruction from the controller 30.

The pilot pump 15 is an example of a pilot pressure generation device, and is configured to supply hydraulic fluid to a hydraulic control device via a pilot line. In the present embodiment, the pilot pump 15 is a fixed capacity hydraulic pump. However, the pilot pressure generation device may be implemented by the main pump 14. That is, the main pump 14 may have a function of supplying hydraulic fluid to the control valve unit 17 via the hydraulic fluid line, and a function of supplying hydraulic fluid to various hydraulic control devices via the pilot line. In such a case, the pilot pump 15 may be omitted.

The control valve unit 17 is a hydraulic control device that controls the hydraulic system in the shovel 100. In the present embodiment, the control valve unit 17 includes control valves 171 to 176. The control valve 175 includes a control valve 175L and a control valve 175R, and the control valve 176 includes a control valve 176L and a control valve 176R. The control valve unit 17 is configured to selectively supply hydraulic fluid discharged from the main pump 14 to one or more hydraulic actuators via the control valves 171 to 176. The control valves 171 to 176 control, for example, flow rates of hydraulic fluid flowing from the main pump 14 to the hydraulic actuators, and the flow rates of hydraulic fluid flowing from the hydraulic actuators to the hydraulic fluid tank. The hydraulic actuators include a boom cylinder 7, an arm cylinder 8, a bucket cylinder 9, a left traveling hydraulic motor 2ML, a right traveling hydraulic motor 2MR, and a turning hydraulic motor 2A.

The operation device 26 is configured such that an operator can operate the actuators. In the present embodiment, the operation device 26 includes a hydraulic actuator operation device configured such that an operator can operate the hydraulic actuators. Specifically, the hydraulic actuator operation device is configured such that hydraulic fluid discharged by the pilot pump 15 can be supplied via the pilot line to a pilot port of a corresponding one of the control valves in the control valve unit 17. The pressure of the hydraulic fluid supplied to each of the pilot ports (pilot pressure) is a pressure corresponding to an operating direction and an operating amount of the operation device 26 corresponding to each of the hydraulic actuators.

The discharge pressure sensor 28 is configured to detect a discharge pressure of the main pump 14. In the present embodiment, the discharge pressure sensor 28 outputs a detected value to the controller 30.

The operation sensor 29 is configured to detect contents of an operation of the operation device 26 by the operator. In the present embodiment, the operation sensor 29 detects an operating direction and an operating amount of the operation device 26 corresponding to each of the actuators, and outputs detected values to the controller 30.

The main pump 14 includes a left main pump 14L and a right main pump 14R. The left main pump 14L circulates hydraulic fluid to the hydraulic fluid tank via a left center bypass conduit 40L or a left parallel conduit 42L, and the right main pump 14R circulates hydraulic fluid to the hydraulic fluid tank via the right center bypass conduit 40R or the right parallel conduit 42R.

The left center bypass conduit 40L is a hydraulic fluid line passing through the control valves 171, 173, 175L, and 176L arranged in the control valve unit 17. The right center bypass conduit 40R is a hydraulic fluid line passing through the control valves 172, 174, 175R, and 176R arranged in the control valve unit 17.

The control valve 171 is a spool valve for switching the flow of the hydraulic fluid to supply hydraulic fluid discharged by the left main pump 14L to the left traveling hydraulic motor 2ML, and discharge the hydraulic fluid discharged by the left traveling hydraulic motor 2ML to the hydraulic fluid tank.

The control valve 172 is a spool valve for switching the flow of the hydraulic fluid to supply the hydraulic fluid discharged by the right main pump 14R to the right traveling hydraulic motor 2MR, and discharge the hydraulic fluid discharged by the right traveling hydraulic motor 2MR to the hydraulic fluid tank.

The control valve 173 is a spool valve for switching the flow of the hydraulic fluid to supply the hydraulic fluid discharged by the left main pump 14L to the turning hydraulic motor 2A, and discharge the hydraulic fluid discharged by the turning hydraulic motor 2A to the hydraulic fluid tank.

The control valve 174 is a spool valve for switching the flow of the hydraulic fluid to supply the hydraulic fluid discharged by the right main pump 14R to the bucket cylinder 9, and discharge the hydraulic fluid in the bucket cylinder 9 to the hydraulic fluid tank.

The control valve 175L is a spool valve for switching the flow of the hydraulic fluid to supply the hydraulic fluid discharged by the left main pump 14L to the boom cylinder 7, and discharge the hydraulic fluid in the boom cylinder 7 to the hydraulic fluid tank. The control valve 175R is a spool valve for switching the flow of the hydraulic fluid to supply the hydraulic fluid discharged by the right main pump 14R to the boom cylinder 7, and discharge the hydraulic fluid in the boom cylinder 7 to the hydraulic fluid tank.

The control valve 176L is a spool valve for switching the flow of the hydraulic fluid to supply the hydraulic fluid discharged by the left main pump 14L to the arm cylinder 8, and discharge the hydraulic fluid in the arm cylinder 8 to the hydraulic fluid tank.

The control valve 176R is a spool valve for switching the flow of the hydraulic fluid to supply the hydraulic fluid discharged by the right main pump 14R to the arm cylinder 8, and discharge the hydraulic fluid in the arm cylinder 8 to the hydraulic fluid tank.

The left parallel conduit 42L is a hydraulic fluid line parallel to the left center bypass conduit 40L. The left parallel conduit 42L may supply hydraulic fluid to a further downstream control valve when hydraulic fluid flowing through the left center bypass conduit 40L is restricted or blocked by any of the control valves 171, 173, and 175L. The right parallel conduit 42R is a hydraulic fluid line parallel to the right center bypass conduit 40R. The right parallel conduit 42R may supply hydraulic fluid to a further downstream control valve when hydraulic fluid flowing through the right center bypass conduit 40R is restricted or blocked by any of the control valves 172, 174, and 175R.

The regulator 13 includes a left regulator 13L and a right regulator 13R. The left regulator 13L controls a discharge amount of the left main pump 14L by adjusting a swash plate inclination angle of the left main pump 14L according to the discharge pressure of the left main pump 14L. Specifically, the left regulator 13L reduces the discharge amount by adjusting the swash plate inclination angle of the left main pump 14L according to an increase in the discharge pressure of the left main pump 14L, for example.

The same applies to the right regulator 13R. This configuration is applied so as not to allow the absorbed power (absorbed horsepower) of the main pump 14 expressed by the product of the discharge pressure and the discharge amount to exceed the output power (output horsepower) of the engine 11.

The operation device 26 includes a left operation lever 26L, a right operation lever 26R, and a traveling lever 26D. The traveling lever 26D includes a left traveling lever 26DL and a right traveling lever 26DR.

The left operation lever 26L is used for turning operation and operating the arm 5. When the left operation lever 26L is operated in the forward-backward direction, the hydraulic fluid discharged from the pilot pump 15 is utilized to introduce a control pressure corresponding to the lever operating amount into the pilot port of the control valve 176. When the left operation lever 26L is operated in the leftward-rightward direction, the hydraulic fluid discharged from the pilot pump 15 is utilized to introduce a control pressure corresponding to the lever operating amount into the pilot port of the control valve 173.

Specifically, when the left operation lever 26L is operated in the arm closing direction, the hydraulic fluid is introduced into a right pilot port of the control valve 176L and a left pilot port of the control valve 176R. When the left operation lever 26L is operated in the arm opening direction, the hydraulic fluid is introduced into the left pilot port of the control valve 176L and the right pilot port of the control valve 176R. When the left operation lever 26L is operated in the left turning direction, the hydraulic fluid is introduced into the left pilot port of the control valve 173, and when the left operation lever 26L is operated in the right turning direction, the hydraulic fluid is introduced into the right pilot port of the control valve 173.

The right operation lever 26R is used for operation of the boom 4 and operation of the bucket 6. When the right operation lever 26R is operated in the forward-backward direction, hydraulic fluid discharged from the pilot pump 15 is utilized to introduce a control pressure corresponding to the lever operating amount into a pilot port of the control valve 175. When the right operation lever 26R is operated in the leftward-rightward direction, the hydraulic fluid discharged from the pilot pump 15 is utilized to introduce a control pressure corresponding to the lever operating amount into the pilot port of the control valve 174.

Specifically, when the right operation lever 26R is operated in the boom lowering direction, the hydraulic fluid is introduced into a left pilot port of the control valve 175R. When the right operation lever 26R is operated in the boom raising direction, hydraulic fluid is introduced into a right pilot port of the control valve 175L, and the hydraulic fluid is also introduced into the left pilot port of the control valve 175R. When the right operation lever 26R is operated in the bucket closing direction, the hydraulic fluid is introduced into the right pilot port of the control valve 174, and when the right operation lever 26R is operated in the bucket opening direction, the hydraulic fluid is introduced into the left pilot port of the control valve 174.

The traveling lever 26D is used to operate the crawler 1C. Specifically, the left traveling lever 26DL is used to operate the left crawler 1CL. The left traveling lever 26DL may be configured to be interlocked with a left traveling pedal. When the left traveling lever 26DL is operated in the forward-backward direction, the hydraulic fluid discharged from the pilot pump 15 is utilized to introduce a control pressure corresponding to the lever operating amount into the pilot port of the control valve 171. The right traveling lever 26DR is used to operate the right crawler 1CR. The right traveling lever 26DR may be configured to be interlocked with a right traveling pedal. When the right traveling lever 26DR is operated in the forward-backward direction, the hydraulic fluid discharged from the pilot pump 15 is utilized to introduce a control pressure corresponding to the lever operating amount into the pilot port of the control valve 172.

The discharge pressure sensor 28 includes a discharge pressure sensor 28L and a discharge pressure sensor 28R. The discharge pressure sensor 28L detects a discharge pressure of the left main pump 14L and outputs a detected value to the controller 30. The same applies to the discharge pressure sensor 28R.

The operation sensor 29 includes operation sensors 29LA, 29LB, 29RA, 29RB, 29DL, and 29DR. The operation sensor 29LA detects contents of an operation in the forward-backward direction with respect to the left operation lever 26L by the operator, and outputs detected values to the controller 30. The contents of the operation are, for example, the lever operating direction, the lever operating amount (lever operation angle), and the like.

Similarly, the operation sensor 29LB detects contents of an operation in the leftward-rightward direction with respect to the left operation lever 26L by the operator, and outputs detected values to the controller 30. The operation sensor 29RA detects contents of an operation in the forward-backward directions with respect to the right operation lever 26R by the operator, and outputs detected values to the controller 30. The operation sensor 29RB detects contents of an operation in the leftward-rightward direction with respect to the right operation lever 26R by the operator, and outputs detected values to the controller 30. The operation sensor 29DL detects contents of an operation in the forward-backward directions with respect to the left traveling lever 26DL by the operator, and outputs detected values to the controller 30. The operation sensor 29DR detects contents of an operation in the forward-backward directions with respect to the right traveling lever 26DR by the operator, and outputs detected values to the controller 30.

The controller 30 receives the output of the operation sensor 29, outputs a control instruction to the regulator 13 as necessary, and changes the discharge amount of the main pump 14. The controller 30 receives the output of the control pressure sensor 19 disposed upstream of the restrictor 18, and outputs a control instruction to the regulator 13 as necessary, and changes the discharge amount of the main pump 14. The restrictor 18 includes a left restrictor 18L and a right restrictor 18R, and the control pressure sensor 19 includes a left control pressure sensor 19L and a right control pressure sensor 19R.

In the left center bypass conduit 40L, a left restrictor 18L is disposed between the most downstream control valve 176L and the hydraulic fluid tank. Therefore, the flow of hydraulic fluid discharged by the left main pump 14L is restricted by the left restrictor 18L. The left restrictor 18L generates a control pressure for controlling the left regulator 13L. The left control pressure sensor 19L is a sensor for detecting the control pressure, and outputs a detected value to the controller 30. The controller 30 controls the discharge amount of the left main pump 14L by adjusting the swash plate inclination angle of the left main pump 14L in accordance with the control pressure. The controller 30 decreases a discharge amount of the left main pump 14L as the control pressure is larger, and increases the discharge amount of the left main pump 14L as the control pressure is smaller. The discharge amount of the right main pump 14R is controlled in the same manner.

Specifically, as illustrated in FIG. 3, when the hydraulic actuators in the shovel 100 are in a standby state in which none of the hydraulic actuators are operated, the hydraulic fluid discharged from the left main pump 14L passes through the left center bypass conduit 40L to the left restrictor 18L. The flow of hydraulic fluid discharged from the left main pump 14L increases the control pressure generated upstream of the left restrictor 18L. As a result, the controller 30 reduces the discharge amount of the left main pump 14L to the minimum allowable discharge amount to prevent the pressure loss (pumping loss) when the discharged hydraulic fluid passes through the left center bypass conduit 40L. On the other hand, when any of the hydraulic actuators is operated, the hydraulic fluid discharged by the left main pump 14L flows into the hydraulic actuator to be operated via the control valve corresponding to the hydraulic actuator to be operated. The flow of the hydraulic fluid discharged by the left main pump 14L reduces or eliminates the amount reaching the left restrictor 18L to reduce the control pressure generated upstream of the left restrictor 18L. As a result, the controller 30 increases the discharge amount of the left main pump 14L, circulates sufficient hydraulic fluid to the hydraulic actuator to be operated, and ensures the operation of the hydraulic actuator to be operated. The controller 30 controls the discharge amount of the right main pump 14R in the same manner.

With the above-described configuration, the hydraulic system illustrated in FIG. 3 can prevent wasteful energy consumption in the main pump 14 in the standby state. The wasteful energy consumption includes the pumping loss caused by the hydraulic fluid discharged by the main pump 14 in the center bypass conduit 40. In addition, the hydraulic system of FIG. 3 can reliably supply necessary and sufficient hydraulic fluid from the main pump 14 to the hydraulic actuator to be operated when the hydraulic actuator is operated.

Figure 4A:
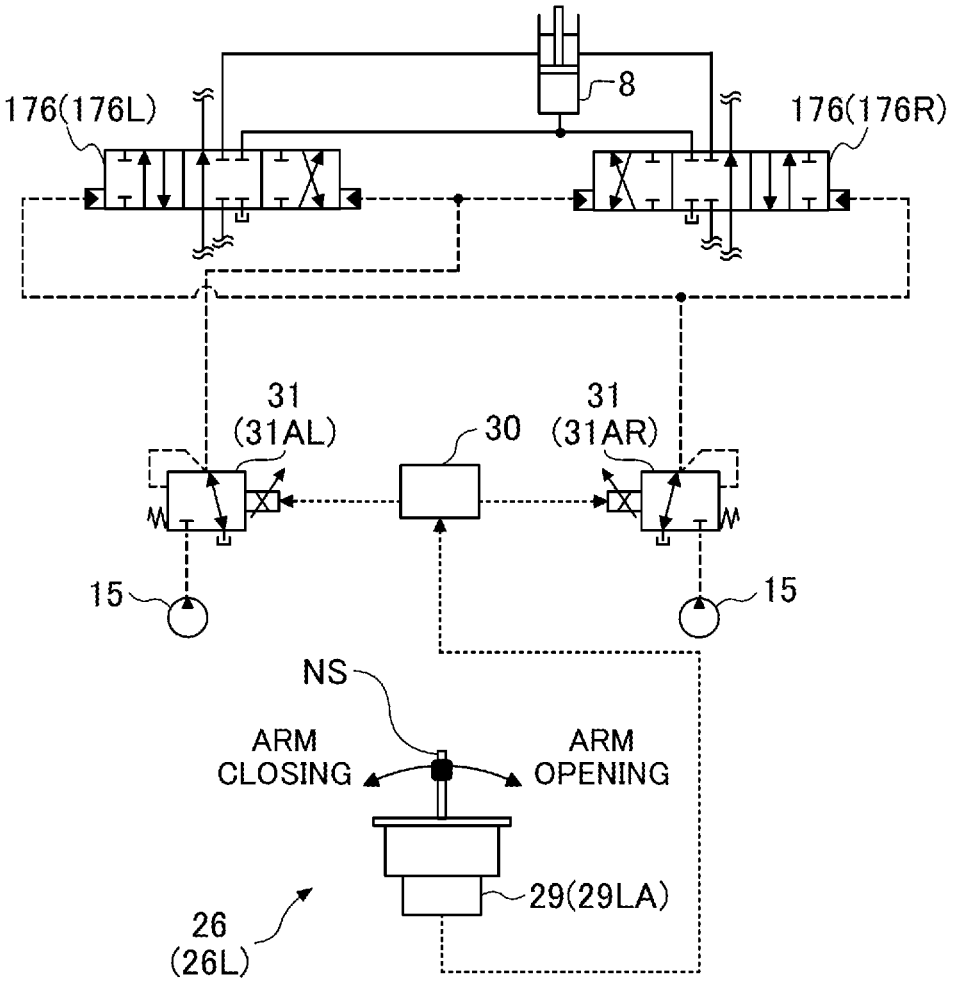
FIG. 4A is a diagram illustrating a part of the hydraulic system for arm cylinder operation.
Figure 4B:
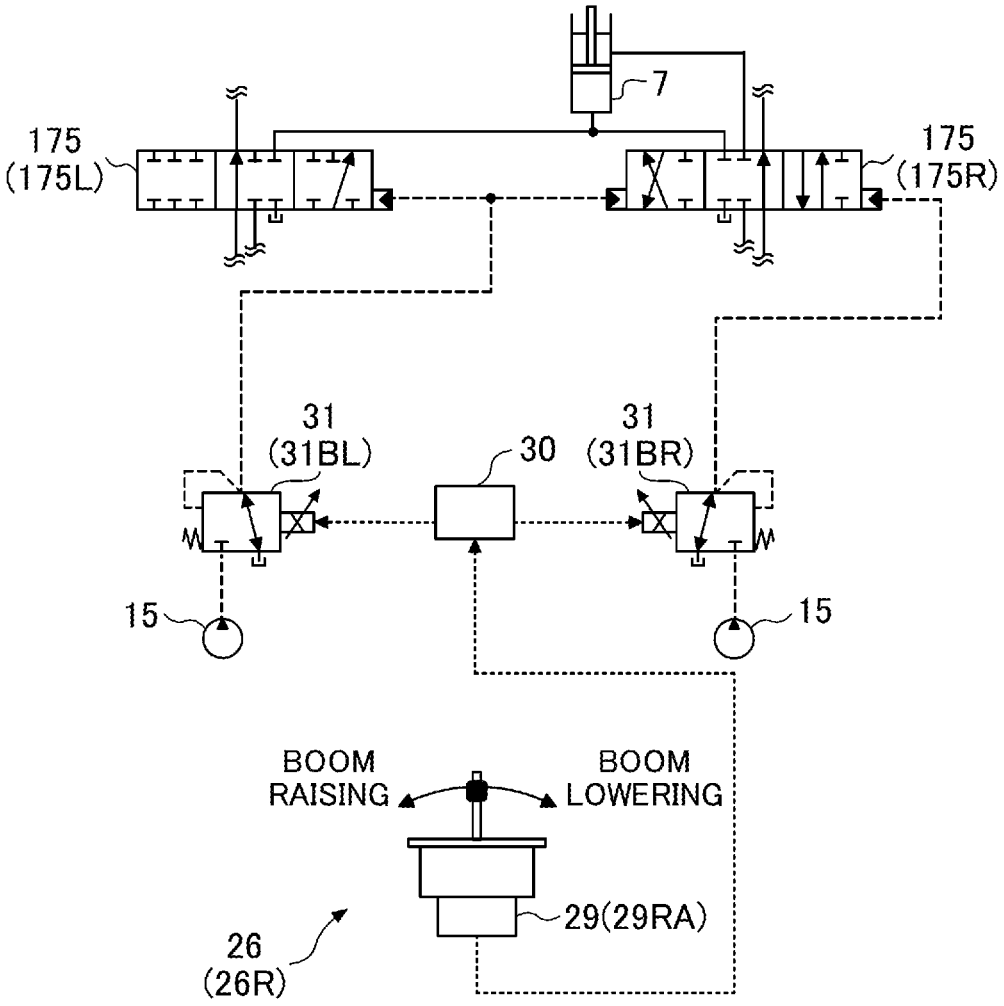
FIG. 4B is a diagram illustrating a part of the hydraulic system for a boom cylinder.
Figure 4C:
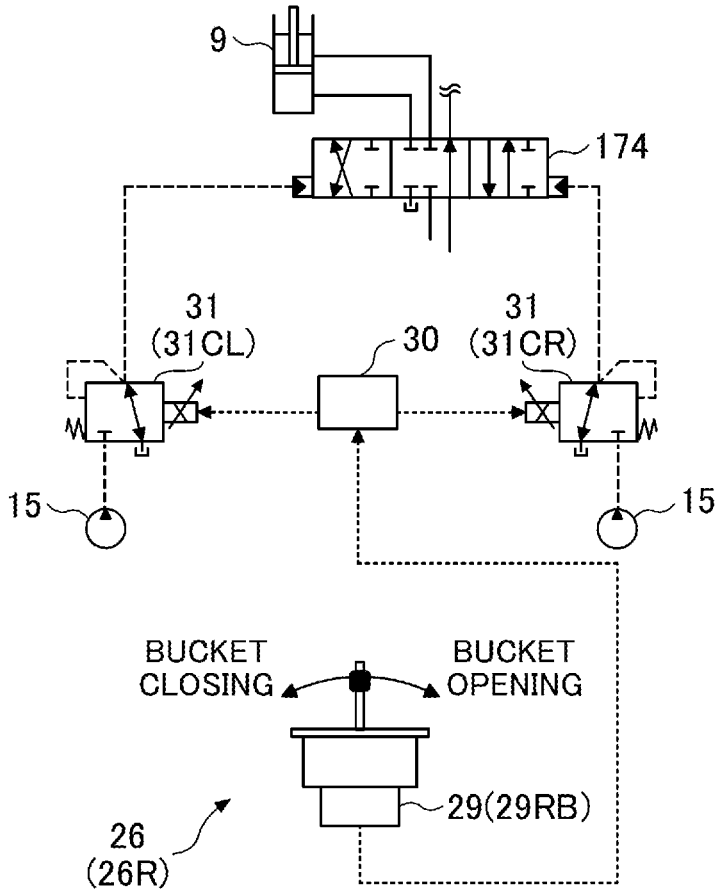
FIG. 4C is a diagram illustrating a part of the hydraulic system for a bucket cylinder.
Figure 4D:
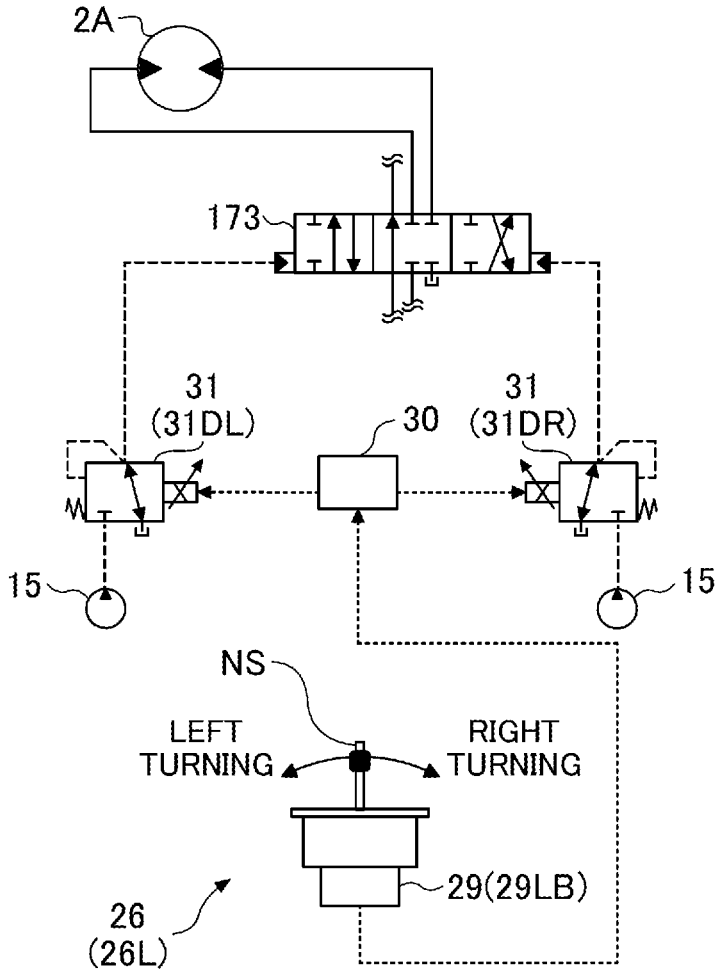
FIG. 4D is a diagram illustrating a part of the hydraulic system for a turning hydraulic motor.

Next, with reference to FIGS. 4A to 4D, a configuration in which the controller 30 operates the actuator by the machine control function will be described. FIGS. 4A to 4D are diagrams in which a part of the hydraulic system is extracted. Specifically, FIG. 4A is a diagram in which a hydraulic system portion related to the operation of the arm cylinder 8 is extracted, and FIG. 4B is a diagram in which a hydraulic system portion related to the operation of the boom cylinder 7 is extracted. FIG. 4C is a diagram in which a hydraulic system portion related to the operation of the bucket cylinder 9 is extracted, and FIG. 4D is a diagram in which a hydraulic system portion related to the operation of the turning hydraulic motor 2A is extracted.

As illustrated in FIGS. 4A to 4D, the hydraulic system includes a proportional valve 31. The proportional valve 31 includes proportional valves 31AL to 31DL and proportional valves 31AR to 31DR.

The proportional valve 31 functions as a control valve for machine control. The proportional valve 31 is arranged in a conduit connecting the pilot pump 15 and a pilot port of the corresponding control valve in the control valve unit 17, and is configured to change a flow passage area of that conduit. In the present embodiment, the proportional valve 31 operates in response to a control instruction output by the controller 30. Therefore, the controller 30 can supply the hydraulic fluid discharged by the pilot pump 15 to the pilot port of the corresponding control valve in the control valve unit 17 via the proportional valve 31, independently of the operator's operation of the operation device 26. The controller 30 can then apply the pilot pressure generated by the proportional valve 31 to the pilot port of the corresponding control valve.

With this configuration, the controller 30 can operate the hydraulic actuator corresponding to the specific operation device 26 even when no operation is performed on the specific operation device 26. The controller 30 can forcibly stop the operation of the hydraulic actuator corresponding to the specific operation device 26 even when an operation is performed on the specific operation device 26.

For example, as illustrated in FIG. 4A, the left operation lever 26L is used to operate the arm 5. Specifically, the left operation lever 26L uses hydraulic fluid discharged from the pilot pump 15, and applies a pilot pressure corresponding to the operation in the longitudinal direction to the pilot port of the control valve 176. More specifically, when the left operation lever 26L is operated in the arm closing direction (backward direction), the pilot pressure corresponding to the operating amount is applied to the right pilot port of the control valve 176L and to the left pilot port of the control valve 176R. When the left operation lever 26L is operated in the arm opening direction (frontward direction), the pilot pressure corresponding to the operating amount is applied to the left pilot port of the control valve 176L and to the right pilot port of the control valve 176R.

The left operation lever 26L is provided with a switch NS. In the present embodiment, the switch NS is a push button switch provided at the tip of the left operation lever 26L. The operator can operate the left operation lever 26L while pressing the switch NS. The switch NS may be provided on the right operation lever 26R or at another position in the cabin 10.

The operation sensor 29LA detects the contents of the operator's operation of the left operation lever 26L in the longitudinal direction, and outputs detected values to the controller 30.

The proportional valve 31AL operates in response to a control instruction (electric current instruction) output by the controller 30. Then, the pilot pressure of the hydraulic fluid introduced from the pilot pump 15 via the proportional valve 31AL into the right pilot port of the control valve 176L and the left pilot port of the control valve 176R is adjusted. The proportional valve 31AR operates in response to a control instruction (electric current instruction) output by the controller 30. Then, the pilot pressure of the hydraulic fluid introduced from the pilot pump 15 via the proportional valve 31AR into the left pilot port of the control valve 176L and the right pilot port of the control valve 176R is adjusted. The proportional valve 31AL can adjust the pilot pressure such that the control valve 176L and the control valve 176R can be stopped at any valve position. Similarly, the proportional valve 31AR can adjust the pilot pressure such that the control valve 176L and the control valve 176R can be stopped at any valve position.

With this configuration, the controller 30 can supply the hydraulic fluid discharged by the pilot pump 15 to the right pilot port of the control valve 176L and the left pilot port of the control valve 176R via the proportional valve 31AL in response to arm closing operation by the operator. The controller 30 can also supply the hydraulic fluid discharged by the pilot pump 15 to the right pilot port of the control valve 176L and the left pilot port of the control valve 176R via the proportional valve 31AL, independently of the arm closing operation by the operator. That is, the controller 30 can close the arm 5, in response to arm closing operation by the operator, or independently of the arm closing operation by the operator.

Further, the controller 30 can supply the hydraulic fluid discharged from the pilot pump 15 to the left pilot port of the control valve 176L and the right pilot port of the control valve 176R via the proportional valve 31AR, in response to the arm opening operation by the operator. Further, the controller 30 can supply the hydraulic fluid discharged from the pilot pump 15 to the left pilot port of the control valve 176L and the right pilot port of the control valve 176R via the proportional valve 31AR, independently of the arm opening operation by the operator. That is, the controller 30 can open the arm 5, in response to the arm opening operation by the operator, or independently of the arm opening operation by the operator.

With this configuration, the controller 30 can reduce the pilot pressure applied to a closed-side pilot port of the control valve 176 (the left pilot port of the control valve 176L and the right pilot port of the control valve 176 R) to forcibly stop the closing operation of the arm 5, as necessary, even when the operator is performing the arm closing operation. The same applies to the case of forcibly stopping the opening operation of the arm 5 when the operator is performing the arm opening operation.

Alternatively, the controller 30 may, as necessary, forcibly stop the closing operation of the arm 5 by controlling the proportional valve 31AR, increasing the pilot pressure applied to an open-side pilot port of the control valve 176 (the right pilot port of the control valve 176L and the left pilot port of the control valve 176 R) on the opposite side of the closed-side pilot port of the control valve 176, and forcibly returning the control valve 176 to the neutral position, even when the operator is performing the arm closing operation. The same applies to the case of forcibly stopping the opening operation of the arm 5 when the operator is performing the arm opening operation.

Although a description with reference to FIGS. 4B to 4D below will be omitted, the same applies to the case where the operation of the boom 4 is forcibly stopped when a boom raising operation or a boom lowering operation is performed by an operator, the case where the operation of the bucket 6 is forcibly stopped when a bucket closing operation or a bucket opening operation is performed by an operator, and the case where the turning operation of the upper turning body 3 is forcibly stopped when a turning operation is performed by an operator. The same applies to the case where the traveling operation of the lower traveling body 1 is forcibly stopped when the traveling operation is performed by an operator.

As illustrated in FIG. 4B, the right operation lever 26R is used to operate the boom 4. Specifically, the right operation lever 26R utilizes the hydraulic fluid discharged from the pilot pump 15, and applies the pilot pressure corresponding to the operation in the longitudinal direction to the pilot port of the control valve 175. More specifically, the right operation lever 26R applies the pilot pressure corresponding to the operating amount to the right pilot port of the control valve 175L and the left pilot port of the control valve 175R when operated in the boom raising direction (backward direction). The right operation lever 26R applies the pilot pressure corresponding to the operating amount to the right pilot port of the control valve 175R when operated in the boom lowering direction (forward direction).

The operation sensor 29RA detects contents of the operation in the forward-backward direction of the right operation lever 26R by the operator, and outputs detected values to the controller 30.

The proportional valve 31BL operates in response to a control instruction (electric current instruction) output by the controller 30. Then, the pilot pressure of the hydraulic fluid introduced from the pilot pump 15 via the proportional valve 31BL into the right pilot port of the control valve 175L and the left pilot port of the control valve 175R is adjusted. The proportional valve 31BR operates in response to a control instruction (electric current instruction) output by the controller 30. Then, the pilot pressure of the hydraulic fluid introduced from the pilot pump 15 via the proportional valve 31BR into the right pilot port of the control valve 175R is adjusted. The proportional valve 31BL can adjust the pilot pressure such that the control valve 175L and the control valve 175R can be stopped at any valve position. The proportional valve 31BR can adjust the pilot pressure such that the control valve 175R can be stopped at any valve position.

With this configuration, the controller 30 can supply the hydraulic fluid discharged from the pilot pump 15 to the right pilot port of the control valve 175L and the left pilot port of the control valve 175R via the proportional valve 31BL in response to the boom-raising operation by the operator. The controller 30 can also supply the hydraulic fluid discharged from the pilot pump 15 to the right pilot port of the control valve 175L and the left pilot port of the control valve 175R via the proportional valve 31BL independently of the boom-raising operation by the operator. That is, the controller 30 can raise the boom 4 in response to the boom raising operation by the operator, or independently of the boom raising operation by the operator.

In addition, the controller 30 can supply the hydraulic fluid discharged from the pilot pump 15 to the right pilot port of the control valve 175R via the proportional valve 31BR in response to the boom lowering operation by the operator. In addition, the controller 30 can supply the hydraulic fluid discharged from the pilot pump 15 to the right pilot port of the control valve 175R via the proportional valve 31BR independently of the boom lowering operation by the operator. That is, the controller 30 can lower the boom 4 in response to the boom lowering operation by the operator, or independently of the boom lowering operation by the operator.

As illustrated in FIG. 4C, the right operation lever 26R is also used to operate the bucket 6. Specifically, the right operation lever 26R utilizes the hydraulic fluid discharged from the pilot pump 15, and applies the pilot pressure corresponding to the operation in the leftward-rightward direction to the pilot port of the control valve 174. More specifically, when operated in the bucket closing direction (leftward direction), the right operation lever 26R applies the pilot pressure corresponding to the operating amount to the left pilot port of the control valve 174. When operated in the bucket opening direction (rightward direction), the right operation lever 26R applies the pilot pressure corresponding to the operating amount to the right pilot port of the control valve 174.

The operation sensor 29RB detects contents of an operation in the leftward-rightward direction to the right operation lever 26R by the operator, and outputs detected values to the controller 30.

The proportional valve 31CL operates in response to a control instruction (electric current instruction) output by the controller 30. Then, the pilot pressure by the hydraulic fluid introduced from the pilot pump 15 to the left pilot port of the control valve 174 via the proportional valve 31CL is adjusted. The proportional valve 31CR operates in response to a control instruction (electric current instruction) output by the controller 30. The pilot pressure by hydraulic fluid introduced from the pilot pump 15 to the right pilot port of the control valve 174 via the proportional valve 31CR is adjusted. The proportional valve 31CL can adjust the pilot pressure such that the control valve 174 can be stopped at any valve position. Similarly, the proportional valve 31CR can adjust the pilot pressure such that the control valve 174 can be stopped at any valve position.

With this configuration, the controller 30 can supply the hydraulic fluid discharged by the pilot pump 15 to the left pilot port of the control valve 174 via the proportional valve 31CL, in response to the bucket closing operation by the operator. The controller 30 can also supply the hydraulic fluid discharged by the pilot pump 15 to the left pilot port of the control valve 174 via the proportional valve 31CL, independently of the bucket closing operation by the operator. That is, the controller 30 can close the bucket 6 in response to the bucket closing operation by the operator, or independently of the bucket closing operation by the operator.

The controller 30 can also supply the hydraulic fluid discharged by the pilot pump 15 to the right pilot port of the control valve 174 via the proportional valve 31CR, in response to the bucket opening operation by the operator. The controller 30 can also supply the hydraulic fluid discharged by the pilot pump 15 to the right pilot port of the control valve 174 via the proportional valve 31CR, independently of the bucket opening operation by the operator. That is, the controller 30 can open the bucket 6, in response to the bucket opening operation by the operator, or independently of the bucket opening operation by the operator.

As illustrated in FIG. 4D, the left operation lever 26L is also used to operate the turning mechanism 2. Specifically, the left operation lever 26L uses hydraulic fluid discharged from the pilot pump 15 and applies a pilot pressure corresponding to operation in the leftward-rightward direction to the pilot port of the control valve 173. More specifically, when the left operation lever 26L is operated in the left turning direction (leftward direction), the pilot pressure corresponding to the operating amount is applied to the left pilot port of the control valve 173. When the left operation lever 26L is operated in the right turning direction (rightward direction), the pilot pressure corresponding to the operating amount is applied to the right pilot port of the control valve 173.

The operation sensor 29LB detects contents of an operation in the leftward-rightward direction with respect to the left operation lever 26L by the operator, and outputs detected values to the controller 30.

The proportional valve 31DL operates in response to a control instruction (electric current instruction) output by the controller 30. Then, the pilot pressure by the hydraulic fluid introduced from the pilot pump 15 to the left pilot port of the control valve 173 via the proportional valve 31DL is adjusted. The proportional valve 31DR operates in response to a control instruction (electric current instruction) output by the controller 30. The pilot pressure by the hydraulic fluid introduced from the pilot pump 15 to the right pilot port of the control valve 173 via the proportional valve 31DR is adjusted. The proportional valve 31DL can adjust the pilot pressure such that the control valve 173 can be stopped at any valve position. Similarly, the proportional valve 31DR can adjust the pilot pressure to stop the control valve 173 at any valve position.

With this configuration, the controller 30 can supply the hydraulic fluid discharged by the pilot pump 15 to the left pilot port of the control valve 173 via the proportional valve 31DL, in response to a left turning operation by the operator. The controller 30 can also supply the hydraulic fluid discharged by the pilot pump 15 to the left pilot port of the control valve 173 via the proportional valve 31DL, independently of the left turning operation by the operator. That is, the controller 30 can turn the turning mechanism 2 to the left, in response to the left turning operation by the operator, or independently of the left turning operation by the operator.

In addition, the controller 30 can supply the hydraulic fluid discharged from the pilot pump 15 to the right pilot port of the control valve 173 via the proportional valve 31DR, in response to a right turning operation by the operator. The controller 30 can supply the hydraulic fluid discharged from the pilot pump 15 to the right pilot port of the control valve 173 via the proportional valve 31DR, independently of the right turning operation by the operator. That is, the controller 30 can turn the turning mechanism 2 to the right, in response to the right turning operation by the operator, or independently of the right turning operation by the operator.

The shovel 100 may be configured to automatically move the lower traveling body 1 forward and backward. In this case, a hydraulic system portion relating to the operation of the left traveling hydraulic motor 2ML and a hydraulic system portion relating to the operation of the right traveling hydraulic motor 2MR may be configured in the same manner as the hydraulic system portion relating to the operation of the boom cylinder 7.

The shovel 100 may be configured to automatically operate the bucket tilt mechanism. In this case, a hydraulic system portion relating to the bucket tilt cylinder constituting the bucket tilt mechanism may be configured in the same manner as the hydraulic system portion relating to the operation of the boom cylinder 7.

Although the electric operation levers have been described as a form of the operation device 26, hydraulic operation levers may be employed instead of the electric operation levers. In this case, a lever operating amount of the hydraulic operation lever may be detected in the form of pressure by a pressure sensor and input to the controller 30. A solenoid valve may be disposed between the operation device 26 as the hydraulic operation lever and the pilot port of each control valve. The solenoid valve is configured to operate, in response to an electrical signal from the controller 30. With this configuration, when a manual operation using the operation device 26 as the hydraulic operation lever is performed, the operation device 26 can move each control valve by increasing or decreasing the pilot pressure in accordance with the lever operating amount. Further, each control valve may be composed of a solenoid spool valve. In this case, the solenoid spool valve operates in response to an electric signal from the controller 30 corresponding to the lever operating amount of the electric operation lever.

Next, an example of a configuration of the controller 30 will be described with reference to FIG. 5.

Figure 5:
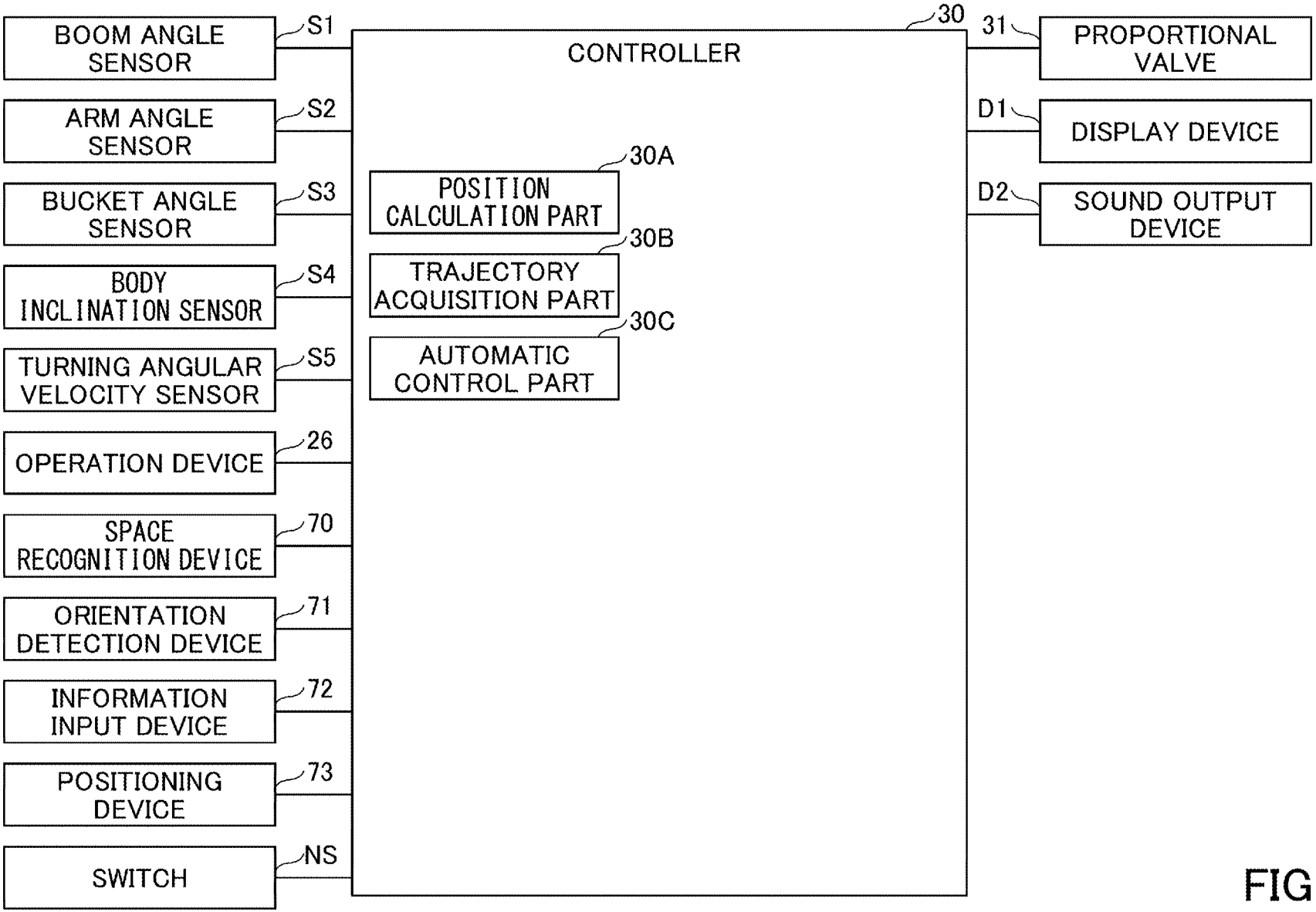
FIG. 5 is a diagram illustrating an example of a configuration of a controller.

FIG. 5 is a diagram illustrating an example of a configuration of the controller 30. In FIG. 5, the controller 30 is configured to receive a signal output by at least one of the attitude detection device, the operation device 26, the space recognition device 70, the orientation detection device 71, the information input device 72, the positioning device 73, the switch NS, and the like, perform various operations, and output a control instruction to at least one of the proportional valve 31, the display device D1, the sound output device D2, and the like. The attitude detection device includes the boom angle sensor S1, the arm angle sensor S2, the bucket angle sensor S3, the body inclination sensor S4, and the turning angular velocity sensor S5. The controller 30 includes a position calculation part 30A, a trajectory acquisition part 30B, and an automatic control part 30C as functional elements. Each functional element may be composed of hardware or software. Although the position calculation part 30A, trajectory acquisition part 30B, and automatic control part 30C are illustrated separately for convenience of Description, these components need not be physically separated and may be composed entirely or partially of common software or hardware components.

The position calculation part 30A is configured to calculate a position of a positioning target. In the present embodiment, the position calculation part 30A calculates coordinate points in the reference coordinate system of a predetermined part of the attachment. The predetermined part is, for example, a claw of the bucket 6. Specifically, the claw of the bucket 6 is a tip of a claw in the center of a plurality of claws attached to the tip of the bucket 6. However, the claw of the bucket 6 may be a tip of a claw on the left end of a plurality of claws attached to the tip of the bucket 6, or a tip of a claw on the right end of a plurality of claws attached to the tip of the bucket 6. The origin of the reference coordinate system is, for example, the intersection point between the turning axis and the ground plane of the shovel 100. The reference coordinate system is, for example, an XYZ orthogonal coordinate system having an X axis parallel to the front-back axis of the shovel 100, a Y axis parallel to the left-right axis of the shovel 100, and a Z axis parallel to the turning axis of the shovel 100. The position calculation part 30A calculates the coordinate points of the claw of the bucket 6 from the respective rotating angles of the boom 4, the arm 5, and the bucket 6, for example. The position calculation part 30A may calculate not only the coordinate points of the tip of the claw at the center but also the coordinate points of the tip of the claw at the left end and the coordinate points of the tip of the claw at the right end. In this case, the position calculation part 30A may utilize the output of the body inclination sensor S4.

The trajectory acquisition part 30B is configured to acquire a target trajectory which is a trajectory followed by the predetermined part of the attachment when the shovel 100 is operated autonomously. In the present embodiment, the trajectory acquisition part 30B acquires a target trajectory to be used by the automatic control part 30C when the shovel 100 is operated autonomously. Specifically, the trajectory acquisition part 30B derives a target trajectory on the basis of data relating to the design surface stored in the nonvolatile storage device. The trajectory acquisition part 30B may derive a target trajectory on the basis of the information on the landform around the shovel 100 recognized by the space recognition device 70. Alternatively, the trajectory acquisition part 30B may derive information on the previous trajectory of the claw of the bucket 6 from the previous output of the attitude detection device stored in the volatile storage device, and derive a target trajectory on the basis of the information. Alternatively, the trajectory acquisition part 30B may derive a target trajectory on the basis of data on the current position of the predetermined part of the attachment and the design surface.

The automatic control part 30C is configured to operate the shovel 100 autonomously. In the present embodiment, when a predetermined start condition is satisfied, the automatic control part 30C is configured to move a predetermined part of the attachment along the target trajectory acquired by the trajectory acquisition part 30B. Specifically, when the operation device 26 is operated while the switch NS is pressed, the shovel 100 is autonomously operated such that the predetermined part moves along the target trajectory.

In the present embodiment, the automatic control part 30C is configured to support the manual operation of the shovel performed by the operator by operating the actuator autonomously. For example, the automatic control part 30C may autonomously extend or retract at least one of the boom cylinder 7, the arm cylinder 8, and the bucket cylinder 9 such that the target trajectory matches the claw position of the bucket 6 when the operator is performing the arm closing operation manually while pressing the switch NS. In this case, the operator can close the arm 5 while making the claw of the bucket 6 match the target trajectory simply by operating the left operation lever 26L in the arm closing direction, for example.

In the present embodiment, the automatic control part 30C can operate actuators autonomously by individually adjusting the pilot pressure applied to a control valve corresponding to each actuator by assigning a control instruction (electric current instruction) to the proportional valve 31. For example, at least one of the boom cylinder 7 and the bucket cylinder 9 can be operated regardless of whether or not the right operation lever 26R is tilted.

Figure 6:
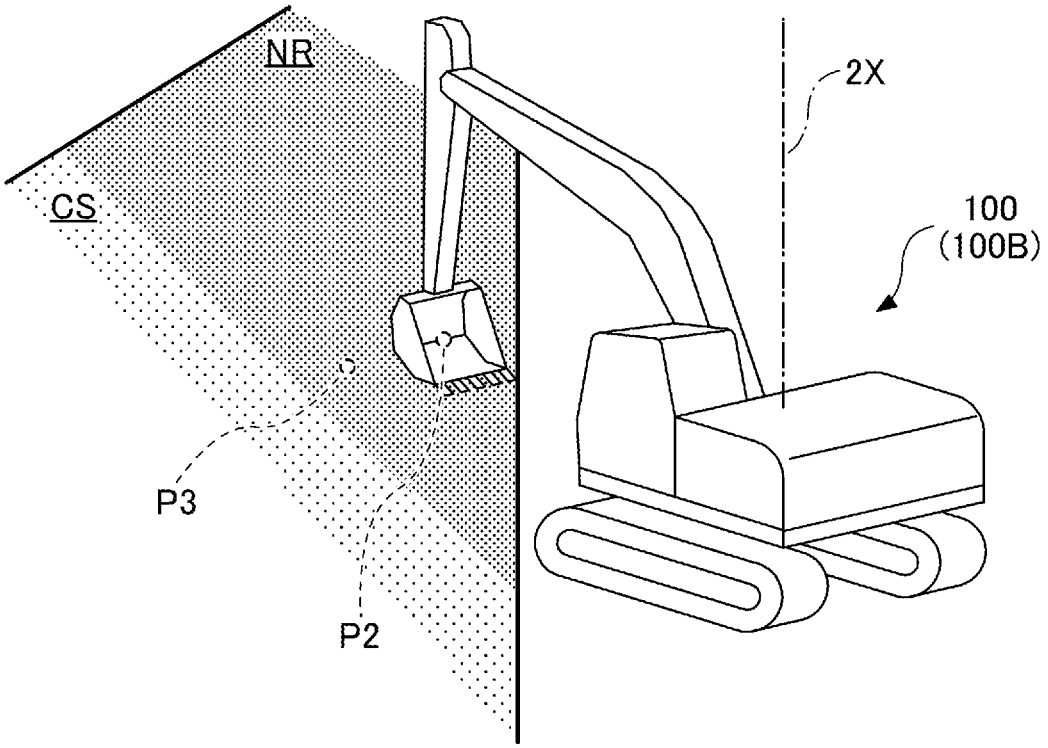
FIG. 6 is a perspective view illustrating the shovel performing a slope shaping work.

Next, with reference to FIGS. 6 and 7, a process in which the controller 30 stops the turning operation by automatic control will be described. FIG. 6 is a perspective view illustrating the shovel 100 when the turning operation is stopped by automatic control, and FIG. 7 is a top view illustrating the shovel 100 in which the turning operation is stopped by automatic control.

Figure 7:
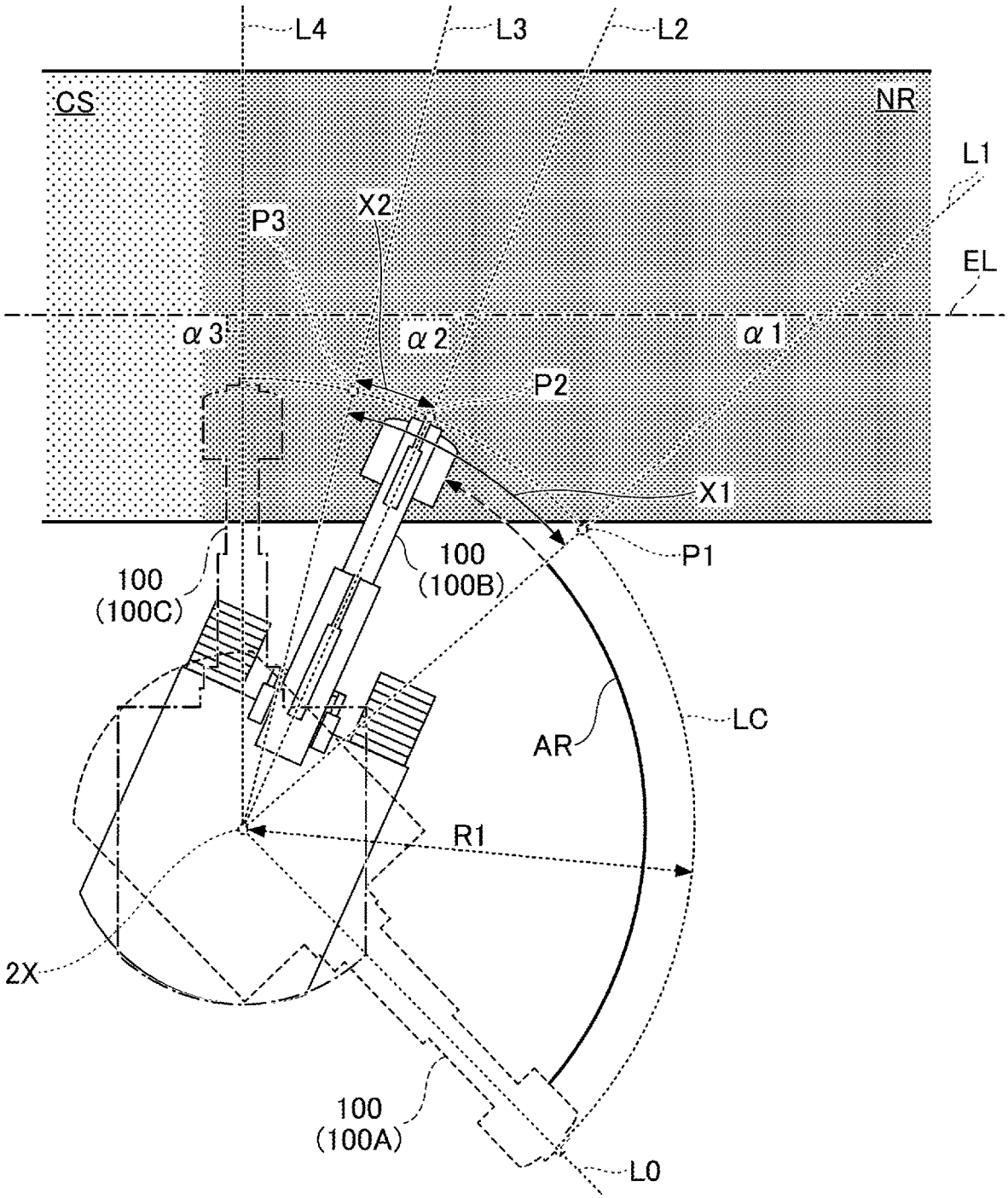
FIG. 7 is a top view illustrating the shovel performing a slope shaping work.

In FIGS. 6 and 7, a range NR represents a range in which the slope (up-slope) is not completed, that is, the ground surface does not match the design surface, and a range CS represents a range in which the slope (up-slope) is completed, that is, the ground surface matches the design surface.

FIGS. 6 and 7 illustrate the shovel 100 that performs a slope shaping work. The slope shaping work includes an excavation work in which earth and sand on a slanting surface is scraped with the bucket 6, and an earth discharge work in which earth and sand gathered in the bucket 6 at the time of the excavation work is discharged in another place. Specifically, FIG. 7 illustrates a state of the shovel 100 when the earth discharge work is completed, which is represented as a shovel 100A plotted with a broken line. Further, FIG. 7 illustrates a state of the shovel 100 when the shovel 100 is made to face the slanting surface (slope) in order to perform a next excavation work, which is virtually represented as a shovel 100C plotted with a dash-dot line.

Note that "making the shovel 100 face the slanting surface (slope)" means, for example, turning the shovel 100 around the turning axis 2X such that the back surface of the bucket 6 and the slope (design surface) can be made parallel. Further, in the example illustrated in FIG. 7, the shovel 100 does not actually reach a state represented as a shovel 100C, because the turning operation is stopped in a state represented as a shovel 100B plotted with the solid line. Therefore, the shovel 100C is represented as a hypothetical state of the shovel 100.

In FIG. 7, an arrow AR represents the turning operation of the upper turning body 3 from the state of the shovel 100 at the completion of the earth discharge work represented by the shovel 100A to the state of the shovel 100 facing the slanting surface (slope) represented by the shovel 100C. This turning operation is implemented by tilting the left operation lever 26L in the left turning direction (leftward direction) while the operator presses the switch NS. The turning radius at this time corresponds to a working radius R1.

FIG. 7 illustrates the state of the shovel 100 when the turning operation is stopped by automatic control as a shovel 100B plotted with a solid line. The shovel 100 illustrated in FIG. 6 corresponds to the shovel 100B.

In FIG. 7, the center line of the shovel 100 (shovel 100A) when the earth discharge work is completed is represented by a broken line L0, the center line of the shovel 100 (shovel 100B) when the turning operation is stopped by the automatic control of the embodiment of the present disclosure is represented by a broken line L2, and the center line of the shovel 100 (shovel 100C) when the shovel is positioned to face the slanting surface (slope) as a design surface is represented by a broken line L4. In FIG. 7, a broken line L1 represents the center line of the shovel 100 when the deceleration of the turning operation is started by the automatic control, and a broken line L3 represents the center line of the shovel 100 when the predetermined part of the excavation attachment AT comes in contact with the slanting surface when automatic control is not applied, and the turning operation is continued without stopping the turning operation. Note that the arrow AR illustrates the turning operation being decelerated, which is represented as a dotted line portion near the end. The broken line L3 (the position where the predetermined part of the excavation attachment AT comes in contact with the slanting surface) is calculated based on the height (or the attitude of the excavation attachment AT) and the turning radius of the bucket 6 on the shovel 100 corresponding to the broken line L1. Therefore, when the height (or the attitude of the excavation attachment AT) and the turning radius of the bucket 6 vary during turning, the position in contact with the design surface (the angle of the broken line L3) also varies. The broken line L3 may be calculated based on the height (or the attitude of the excavation attachment AT) and the turning radius of the bucket 6 at the time of discharging the earth and sand.

For example, the controller 30 calculates the trajectory (hereinafter referred to as "turning trajectory") followed by a predetermined part of the attachment (in this example, a predetermined point of the bucket 6) when the left operation lever 26L is operated to start the turning operation while the switch NS is pressed. The turning trajectory is calculated based on, for example, information on the position of the upper turning body 3 output by the positioning device 73 and information on the attitude of the excavation attachment AT output by the attitude detection device. FIG. 7 illustrates the turning trajectory with a broken line LC.

When the turning operation is continued, the controller 30 determines whether the bucket 6 comes in contact with the design surface, i.e., whether the bucket 6 digs into the slanting surface beyond the design surface, before the shovel 100 faces the slanting surface (slope). Specifically, the controller 30 determines whether the design surface intersects the turning trajectory followed by the predetermined point of the bucket 6.

This determination is based on, for example, data on the design surface stored in the nonvolatile storage device, information on the position of the upper turning body 3 output by the positioning device 73, and information on the attitude of the excavation attachment AT output by the attitude detection device. The controller 30 may determine whether or not the bucket 6 comes into contact with the design surface based on information output by the space recognition device 70.

When the controller 30 determines that the bucket 6 comes into contact with the design surface, the controller 30 stops the turning operation when a predetermined condition is satisfied. The predetermined condition is, for example, whether or not the distance (hereinafter referred to as "calculated distance") between the current position of the predetermined point of the bucket 6 and a contact point (see point P3) has fallen below a predetermined distance. The contact point corresponds to an estimated position of the predetermined point of the bucket 6 when the bucket 6 comes in contact with the design surface before the shovel 100 faces the slanting surface (slope) when the turning operation is continued. In the example illustrated in FIG. 7, the calculated distance is the distance along the turning trajectory represented by the broken line LC. However, the calculated distance may be the linear distance between the current position of the predetermined point of the bucket 6 and the contact point.

Even when the controller 30 decelerates or stops the turning operation, if a turning operation is subsequently performed in the opposite direction of the turning direction before the predetermined condition is satisfied, the controller 30 permits the turning operation in response to that subsequently performed turning operation. For example, even when the controller 30 determines that the predetermined condition is satisfied, and decelerates or stops the left turning operation, if the right turning operation is subsequently performed, the controller turns the upper turning body 3 to the right in response to the subsequently performed right turning operation. That is, the controller 30 does not restrict or prohibit the turning operation for moving the bucket 6 away from the slanting surface (slope). Also, the controller 30 does not restrict or prohibit operations other than the turning operation, such as the boom raising operation.

The controller 30 is configured so as not to stop the turning operation by automatic control when the switch NS is not pressed even when the predetermined condition is satisfied. This is because the operator may intentionally make the bucket 6 contact with the slanting surface (slope). That is, the operator can make the bucket 6 contact with the slanting surface (slope) by performing the turning operation without pressing the switch NS.

In the example illustrated in FIG. 7, the controller 30 calculates the height (or, the attitude of the excavation attachment AT) and the turning radius of the bucket 6 at a predetermined control period during turning.

The controller 30 calculates the distance from a predetermined part of the excavation attachment AT to the design surface at the predetermined control period, based on the height (or the attitude of the excavation attachment AT) and the turning radius of the bucket 6 calculated during turning. The controller 30 compares the distance from the predetermined part of the excavation attachment AT to the design surface calculated at the predetermined control period with each of the predetermined distances X1 and X2. When the calculated distance falls below the distance X1, the controller 30 starts to decelerate the turning operation of the upper turning body 3. Specifically, the controller 30 decelerates the turning operation of the upper turning body 3 at a predetermined deceleration rate. The predetermined deceleration rate may be unchanged or variable. Then, the controller 30 stops the turning operation of the upper turning body 3 when the calculated distance becomes the distance X2(<distance X1). Note that a point P1 in FIG. 7 represents a position of the predetermined part when the deceleration of the turning operation is started. A point P2 in FIGS. 6 and 7 represents a position of the predetermined part when the turning operation is stopped. A point P3 in FIGS. 6 and 7 represents an estimated position of the predetermined part, that is, an estimated position of the contact point, when the bucket 6 comes into contact with the design surface when the turning operation is continued without stopping the turning operation by automatic control. Specifically, the estimated position of the contact point corresponds to a position of the intersection point between the turning trajectory followed by the predetermined point of the bucket 6 and the design surface when the turning operation is continued.

In the example illustrated in FIG. 7, the controller 30 is configured such that the distance X1 as a threshold value varies as the working radius R1 varies. Specifically, the distance X1 is set such that the larger the working radius R1, the larger the distance X1 becomes. This is because the larger the working radius R1, the larger the moment of inertia of the excavation attachment AT, making it more difficult to stop the turning operation. For the same reason, the controller 30 may be configured such that the distance X2 as a threshold value varies as the working radius R1 varies. However, the controller 30 may be configured such that the distance X1 is constant independently of the working radius R1.

Alternatively, the controller 30 may be configured such that the distance X1 as a threshold value varies with a change in the attitude of the excavation attachment AT. For example, the distance X1 may be set such that the larger the boom angle θ1, the smaller the distance X1 becomes, and the smaller the arm angle θ2, the smaller the distance X1 becomes.

Alternatively, the controller 30 may be configured such that the distance X1 as a threshold value varies with a change in turning velocity. For example, the distance X1 may be set such that the larger the turning velocity, the larger the distance X1 becomes.

When the turning velocity of the upper turning body 3 is less than a predetermined velocity, the controller 30 may stop the upper turning body 3 without decelerating the upper turning body 3, instead of decelerating the turning operation of the upper turning body 3 and then stopping it.

The predetermined condition may be, for example, whether or not the angle (hereinafter referred to as "calculated angle") formed between a virtual line EL indicating an extending direction of the slope in the top view and the center line of the shovel 100 in the top view exceeds a predetermined angle.

In the example illustrated in FIG. 7, the controller 30 calculates the height (or, the attitude of the excavation attachment AT) and the turning radius of the bucket 6 at a predetermined control period during turning. The controller 30 calculates the turning angle from the predetermined part of the excavation attachment AT to the design surface as the calculated angle at the predetermined control period, based on the height (or, the attitude of the excavation attachment AT) and the turning radius of the bucket 6 calculated during turning. The controller 30 compares the turning angle from the predetermined part of the excavation attachment AT to the design surface calculated at the predetermined control period with each of the predetermined angles α1 and α2.

In the example illustrated in FIG. 7, the angles α1 and α2 are angles formed between the virtual line EL indicating the extending direction of the slope surface in the top view and the center line of the shovel 100 in the top view. In the example illustrated in FIG. 7, the calculated angle is an angle that becomes the maximum angle (90 degrees) when the shovel 100 faces the slanting surface (slope), and the closer the shovel 100 approaches a facing state, the closer the maximum angle becomes. Therefore, the angles α1 and α2 are set as angles less than 90 degrees.

When the calculated angle exceeds the angle α1, the controller 30 starts decelerating the turning operation of the upper turning body 3. Specifically, the controller 30 decelerates the turning operation of the upper turning body 3 at a predetermined deceleration rate. The predetermined deceleration rate may be unchanged or variable. Then, the controller 30 stops the turning operation of the upper turning body 3 when the calculated angle becomes angle α2 (>angle α1). FIG. 7 illustrates that the calculated angle becomes angle α3 when the shovel 100 is made to face the slanting surface (slope) in order to execute the next excavation work.

The state of the shovel 100 when the shovel 100 is made to face the slanting surface (slope) is a state in which the working plane of the excavation attachment AT includes a direction (normal direction) perpendicular to the design surface (slanting surface). The working plane of the excavation attachment AT is, for example, a virtual plane including the longitudinal center line of the excavation attachment AT.

When the controller 30 determines that the bucket 6 is not in contact with the design surface, the controller 30 may be configured to stop the turning operation by automatic control such that the turning operation of the upper turning body 3 is stopped when the upper turning body 3 faces the slanting surface (slope). Thus, when the controller 30 determines that the bucket 6 is not in contact with the design surface, the operator of the shovel 100 can make the shovel 100 face the slanting surface (slope) directly by simply tilting the left operation lever 26L in the left turning direction with a desired operating amount without worrying about the contact between the bucket 6 and the design surface. Regardless of the determination result of whether the bucket 6 is in contact with the design surface or not, the turning operation of the upper turning body 3 is properly stopped.

With the above-described configuration, the controller 30 gradually stops the turning operation rather than abruptly stopping the turning operation when the predetermined condition is satisfied, such that the operator of the shovel 100 does not feel any discomfort.

The controller 30 is also configured to automatically stop the turning operation independently of the operating amount of the left operation lever 26L in order to avoid contact between the bucket 6 and the design surface. That is, even when the left operation lever 26L is tilted in the left turning direction by the operator of the shovel 100, the left turning operation can be automatically stopped. In the example illustrated in FIG. 7, the controller 30 automatically stops the turning operation to avoid contact between the bucket 6 and the design surface, but does not automatically stop other operations. For example, when a predetermined condition is satisfied while the operator of the shovel 100 is performing a combined operation including a left turning operation and a boom raising operation, the controller 30 automatically stops the left turning operation but does not automatically stop the boom raising operation.

Specifically, when the calculated distance falls below the distance X1 while the operator is performing a combined operation including a left turning operation and a boom raising operation, the controller 30 decelerates or stops the left turning operation by automatic control, but does not decelerate or stop the boom raising operation by automatic control. Therefore, the boom 4 is continuously raised in response to the boom raising operation by the operator. When the boom 4 is raised, the calculated distance again exceeds the distance X1 due to an inclination (upward gradient) of the slanting surface (slope). When the calculated distance again exceeds the distance X1, the controller 30 cancels the deceleration or stoppage of the turning operation by automatic control. At this time, when the operator continues the left turning operation, the controller 30 resumes the unrestricted left turning operation in accordance with the left turning operation. As a result, the controller 30 can turn the upper turning body 3 to the left and raise the boom 4 until the combined operation by the operator is interrupted while keeping the distance between the predetermined point of the bucket 6 and the slanting surface (slope) substantially constant. Note that the combined operation may include other operations such as an arm closing operation.

Alternatively, when the calculated distance falls below the distance X1 while the operator is performing a combined operation including a left turning operation and an arm closing operation, the controller 30 decelerates or stops the left turning operation by automatic control, but does not decelerate or stop the arm closing operation by automatic control. Therefore, the arm 5 is continuously closed in response to the arm closing operation by the operator. When the arm 5 is closed, the calculated distance again exceeds the distance X1 due to the inclination (upward gradient) of the slanting surface (slope). When the calculated distance again exceeds the distance X1, the controller 30 cancels the deceleration or stoppage of the turning operation by automatic control. At this time, when the operator continues the left turning operation, the controller 30 resumes the unrestricted left turning operation in accordance with the left turning operation. As a result, the controller 30 can turn the upper turning body 3 to the left and close the arm 5 until the combined operation by the operator is interrupted while keeping the distance between the predetermined point of the bucket 6 and the slanting surface (slope) substantially constant. The combined operation may include other operations such as a bucket closing operation.

Alternatively, when the calculated distance falls below the distance X1 while the operator is performing a combined operation including a left turning operation and a traveling operation, the controller 30 automatically decelerates or stops the left turning operation, but does not automatically decelerate or stop the traveling operation in the direction away from the slanting surface (slope). Therefore, the lower traveling body 1 is continuously moved away from the slanting surface (slope) in response to the traveling operation by the operator. When the lower traveling body 1 is moved away from the slanting surface (slope), the calculated distance again exceeds the distance X1. When the calculated distance again exceeds the distance X1, the controller 30 cancels the deceleration or stoppage of the turning operation by automatic control. At this time, when the operator continues the left turning operation, the controller 30 resumes the unrestricted left turning operation in response to the left turning operation. As a result, the controller 30 can turn the upper turning body 3 to the left and move the lower traveling body 1 away from the slanting surface (slope) until the combined operation by the operator is interrupted while keeping the distance between the predetermined point of the bucket 6 and the slanting surface (slope) substantially constant.

On the other hand, when the lower traveling body 1 is moving in the direction approaching the slanting surface (slope), and the calculated distance falls below the distance X1 while the operator is performing the combined operation including the left turning operation and the traveling operation, the controller 30 decelerates or stops the left turning operation by the automatic control, and also decelerates or stops the traveling operation in the direction approaching the slanting surface (slope) by the automatic control. This is because in this case, contact between the bucket 6 and the slanting surface (slope) cannot be avoided only by stopping the turning operation.

Note that the controller 30 does not operate the excavation attachment by automatic control for the purpose of avoiding contact between the bucket 6 and the slanting surface (slope) when the turning operation is performed by the operator independently and no other operation is performed by the operator.

For example, even if the calculated distance falls below the distance X1, the controller 30 does not raise the boom 4 by automatic control for the purpose of avoiding contact between the bucket 6 and the slanting surface (slope) when the left turning operation is performed by the operator independently and when the boom raising operation is not performed by the operator. In this case, the controller 30 only stops the left turning operation by automatic control, that is, only completely stops the movement of the shovel 100.

Further, the controller 30 does not close the arm 5 by automatic control for the purpose of avoiding contact between the bucket 6 and the slanting surface (slope) when the left turning operation is performed by the operator independently and the arm closing operation is not performed by the operator. Similarly, the controller 30 does not close the bucket 6 by automatic control for the purpose of avoiding contact between the bucket 6 and the slanting surface (slope) when the left turning operation is performed by the operator independently and the bucket closing operation is not performed by the operator.

As described above, the shovel 100 according to the embodiment of the present disclosure includes the lower traveling body 1, the upper turning body 3 turnably mounted on the lower traveling body 1, and the attachment attached to the upper turning body 3. The shovel 100 is configured to automatically decelerate or stop turning of the upper turning body 3 when interference between the attachment and a stop reference surface, which is an example of a control reference surface, is predicted (e.g., the attachment is predicted to cross the stop reference surface) while the upper turning body 3 is turning. For example, the controller 30, which is an example of a shovel control device mounted on the shovel 100, may be configured to automatically decelerate or stop the turning of the upper turning body 3 when interference between the attachment and a stop reference surface, which is an example of a control reference surface, is predicted (e.g., the attachment is predicted to cross the stop reference surface) while the upper turning body 3 is turning. The shovel control device may be a different control device from the controller 30. Specifically, the shovel control device may be a control device detachably installed in the cabin 10 or a portable control device. The shovel control device may also be a control device capable of performing some of the functions of the controller 30.

The stop reference surface is, for example, a virtually set surface in a reference coordinate system, typically a design surface. The stop reference surface may be a plane or a curved surface. The stop reference surface may be a complex surface composed of a plurality of planes, a plurality of curved surfaces, or a combination thereof. The stop reference surface may be a virtual surface that can be optionally set by the operator of the shovel 100 through the information input device 72. The stop reference surface may be a virtual surface generated based on the information recognized by the space recognition device 70.

This configuration allows for more appropriate automatic control of the shovel 100 because the configuration can prevent the attachment from accidentally crossing (excavating into) the stop reference surface (design surface) due to the turning operation. Specifically, this configuration can automatically decelerate or stop the turning operation according to a manual turning operation by the operator of the shovel 100, thereby preventing damage to the stop reference surface due to an erroneous or improper turning operation by the operator. Therefore, this configuration can assist the operator such that a construction surface such as a slope is accurately formed according to the design surface.

In addition, the shovel 100 may be configured to prohibit the boom raising operation by automatic control when decelerating or stopping the turning of the upper turning body 3. This configuration can prevent the boom 4 from being forced to rise in order to avoid contact between the attachment and the stop reference surface, even if the operator is not performing the boom raising operation. Therefore, this configuration can prevent such events as the attitude of the shovel 100 becoming unstable (the shovel 100 is about to fall) or the boom 4 being brought into contact with the electric wire which is placed above the shovel 100.

The shovel 100 may be configured to decelerate the turning of the upper turning body 3 when a predetermined part of the attachment is located within a preset deceleration region. For example, in the example illustrated in FIG. 7, when a predetermined point of the bucket 6, which is an example of a predetermined part of the attachment, reaches the point P1, the controller 30 is configured to start decelerating the turning of the upper turning body 3. The point P1 is a point on the turning trajectory followed by that predetermined point of the bucket 6 when the turning operation is being performed, and the distance from another point P3 on the turning trajectory (the distance along the turning trajectory) to this point P1 is equal to the threshold value (the distance X1). The point P3 is an intersection point between the turning trajectory and the stop reference surface (the design surface). The point P2 between the point P1 and the point P3 on the turning trajectory is a point where the predetermined point of the bucket 6 is located when the turning of the upper turning body 3 is stopped. The controller 30 stops the turning of the upper turning body 3 by automatic control such that the predetermined point of the bucket 6 is located at the point P2 when the turning of the upper turning body 3 is stopped. In this case, the deceleration region means, for example, a section between the point P1 and the point P2 on the turning trajectory.

With this configuration, the shovel 100 can smoothly stop the upper turning body 3 before the predetermined part of the attachment crosses the stop reference surface. Therefore, the shovel 100 can prevent the attitude of the shovel 100 from becoming unstable due to the sudden stoppage of the upper turning body 3.

The shovel 100 may be configured such that the deceleration region varies with the attitude of the attachment. Specifically, the shovel 100 may be configured such that the width of the deceleration region decreases as the working radius of the attachment decreases. For example, in the example illustrated in FIG. 7, the shovel 100 is configured such that the deceleration region increases as the working radius R1 increases. This configuration has the effect of surely stopping the turning of the upper turning body 3 at a desired position because the larger the moment of inertia of the attachment, the earlier the deceleration of the turning operation can be started. This configuration also has the effect of preventing excessive premature deceleration of the turning of the upper turning body 3, because the smaller the moment of inertia of the attachment, the later the start of deceleration of the turning motion can be delayed.

The stop reference surface may be acquired as design information or may be acquired by an imaging device. Specifically, the stop reference surface may be a virtual surface generated on the basis of data on the design surface stored in the nonvolatile storage device of the controller 30, or may be a virtual surface generated on the basis of image data acquired by the imaging device, which is an example of the space recognition device 70. With this configuration, the operator of the shovel 100 can quickly and easily obtain the stop reference surface.

The shovel 100 may decelerate or stop the lower traveling body 1 when the attachment is predicted to cross the stop reference surface while the lower traveling body 1 is traveling. For example, the controller 30 may be configured to decelerate or stop the lower traveling body 1 when the bucket 6 is predicted to contact the stop reference surface (design surface) when the traveling operation for bringing the lower traveling body 1 closer to the slanting surface (slope) and the turning operation for bringing the bucket 6 closer to the slanting surface (slope) are simultaneously performed during the slope shaping work. This is because the contact between the bucket 6 and the design surface may not be avoided only by stopping the turning operation. With this configuration, the shovel 100 can surely avoid the contact between the bucket 6 and the design surface by stopping at least one of the traveling of the lower traveling body 1 and the turning of the upper turning body 3 even when the combined operation including the traveling operation and the turning operation is performed.

The preferred embodiment of the present disclosure has been described in detail. However, the present invention is not limited to the embodiment described above. The embodiment described above may be subject to various modifications, substitutions, and the like, without departing from the scope of the present invention. In addition, the features described separately may be combined, provided that no technical inconsistencies arise.

It should be understood that the invention is not limited to the above-described embodiment, but may be modified into various forms on the basis of the spirit of the invention. Additionally, the modifications are included in the scope of the invention.

What is claimed is:

1. A shovel comprising:

a lower traveling body;

an upper turning body turnably mounted on the lower traveling body;

an attachment mounted on the upper turning body, the attachment including a bucket; and a control device including a memory storing a program and a processor coupled to the memory and configured to, while the upper turning body is turning, determine whether a turning trajectory followed by a predetermined point of the bucket intersects a design surface on condition that the upper turning body continues turning toward the design surface, automatically decelerate or stop the turning of the upper turning body in response to determining that the turning trajectory intersects the design surface, and automatically stop the turning of the upper turning body when the upper turning body faces the design surface, in response to determining that the turning trajectory does not intersect the design surface.

2. The shovel according to claim 1, wherein the processor is further configured to prohibit a boom raising operation by automatic control in response to determining that the turning trajectory intersects the design surface, while the upper turning body is turning toward the design surface.

3. The shovel according to claim 1, wherein the processor is further configured to decelerate the turning of the upper turning body when the predetermined point of the bucket is located in a preset deceleration region.

4. The shovel according to claim 3, wherein the deceleration region varies with an attitude of the attachment.

5. The shovel according to claim 3, wherein a width of the deceleration region decreases as a working radius of the attachment decreases.

6. The shovel according to claim 1, wherein the design surface is acquired as design information or is acquired by an imaging device.

7. The shovel according to claim 1, wherein the processor is further configured to decelerate or stop the lower traveling body in response to determining that the turning trajectory intersects the design surface, while the lower traveling body is traveling toward the design surface.

8. The shovel according to claim 1, wherein the processor is further configured to automatically decelerate or stop the turning of the upper turning body in response to determining that the turning trajectory intersects the design surface, when the turning of the upper turning body is started with a predetermined switch being operated, and not automatically decelerate or stop the turning of the upper turning body in response to determining that the turning trajectory intersects the design surface, when the turning of the upper turning body is started without the predetermined switch being operated.

9. The shovel according to claim 1, wherein the processor is further configured to automatically stop the turning of the upper turning body when the upper turning body faces the design surface with a working plane of the attachment including a direction perpendicular to the design surface, in response to determining that the turning trajectory does not intersect the design surface.

10. A shovel control device for controlling a shovel, the shovel including a lower traveling body, an upper turning body turnably mounted on the lower traveling body, and an attachment attached to the upper turning body, the attachment including a bucket, the shovel control device comprising:

a memory storing a program and a processor coupled to the memory and configured to, while the upper turning body is turning, determine whether a turning trajectory followed by a predetermined point of the bucket intersects a design surface on condition that the upper turning body continues turning toward the design surface, automatically decelerate or stop the turning of the upper turning body in response to determining that the turning trajectory intersects the design surface, and automatically stop the turning of the upper turning body when the upper turning body faces the design surface, in response to determining that the turning trajectory does not intersect the design surface.

11. The shovel control device according to claim 10, wherein the processor is further configured to prohibit a boom raising operation by automatic control in response to determining that the turning trajectory intersects the design surface, while the upper turning body is turning toward the design surface.

12. The shovel control device according to claim 10, wherein the processor is further configured to decelerate the turning of the upper turning body when the predetermined point of the bucket is located in a preset deceleration region.

13. The shovel control device according to claim 12, wherein the deceleration region varies with an attitude of the attachment.

14. The shovel control device according to claim 12, wherein a width of the deceleration region decreases as a working radius of the attachment decreases.

15. The shovel control device according to claim 10, wherein the design surface is acquired as design information or is acquired by an imaging device.

16. The shovel control device according to claim 10, wherein the processor is further configured to decelerate or stop the lower traveling body in response to determining that the turning trajectory intersects the design surface, while the lower traveling body is traveling toward the design surface.

17. The shovel control device according to claim 10, wherein the processor is further configured to automatically decelerate or stop the turning of the upper turning body in response to determining that the turning trajectory intersects the design surface, when the turning of the upper turning body is started with a predetermined switch being operated, and not automatically decelerate or stop the turning of the upper turning body in response to determining that the turning trajectory intersects the design surface, when the turning of the upper turning body is started without the predetermined switch being operated.

18. The shovel control device according to claim 10, wherein the processor is further configured to automatically stop the turning of the upper turning body when the upper turning body faces the design surface with a working plane of the attachment including a direction perpendicular to the design surface, in response to determining that the turning trajectory does not intersect the design surface.

* * * * *